United States Patent [19]

Uetrecht

[11] 4,122,744

[45] Oct. 31, 1978

[54] VARIABLE FREQUENCY GENERATOR FOR POLYPHONIC ELECTRONIC MUSIC SYSTEM

[75] Inventor: Dale M. Uetrecht, Colerain Township, Hamilton County, Ohio

[73] Assignee: D. H. Baldwin Company, Cincinnati, Ohio

[21] Appl. No.: 824,562

[22] Filed: Aug. 15, 1977

[51] Int. Cl.[2] ..... G10H 1/04; G10H 5/00

[52] U.S. Cl. ..... 84/1.25; 84/1.24; 84/DIG. 2; 84/DIG. 4

[58] Field of Search ..... 84/1.24, 1.25, DIG. 2, 84/DIG. 4

[56] References Cited

U.S. PATENT DOCUMENTS

| | | | |
|---|---|---|---|
| 3,288,907 | 11/1966 | George | 84/1.25 |
| 3,647,928 | 3/1972 | Turner | 84/1.24 |
| 3,711,620 | 1/1973 | Kameoka et al. | 84/1.24 |
| 3,973,463 | 8/1976 | Schreier | 84/1.25 |
| 4,078,466 | 3/1978 | Suenaga et al. | 84/1.24 |

*Primary Examiner*—Stanley J. Witkowski
*Attorney, Agent, or Firm*—Kirkland & Ellis

[57] ABSTRACT

Simultaneously played notes on a keyboard are automatically provided with different voice timbres. The assignment of voices to notes is by relative frequency-scale position within the chord. If four or more notes are played, the notes are scanned along the musical scale and the three lowest notes played and the highest note are sounded in different voices with the solo voice assigned to the highest note. Assignment of voices occurs automatically when fewer than four keys are played. One form of the system combines time multiplexed keying with priority coupling of the keying information to a plurality of voltage controlled oscillators through sample-and-hold memory circuits. Each oscillator has its own tone voicing circuits. In another preferred all-digital embodiment, the time division multiplex digital logic signals representative of the played keys are applied instead to a memory circuit and a comparator circuit. If the information stored in the memory from the previous scan cycle is the same as the information of the present cycle, thereby indicating no change in played keys, the comparator provides an enabling signal to a monostable and enable logic circuit. A priority selector circuit provides logic information representative of the three lowest keys played and the highest key played to the monostable and enable logic circuit. The monostable and enable logic circuit provides on four outputs information representative of the three lowest keys played and the highest key played and also information representative of the total number of keys played. This information is combined with the octave information and the note time slot information in four programmable counter circuits which divide four input frequencies from a rate scaler frequency generator to produce four tone signals having fundamental output frequencies f1 - fH corresponding to the three lowest notes and single highest note played. Also, the four programmable counter circuits provide control voltages corresponding to the played notes. The tone signals and control voltages are applied to voltage controlled gates and filter circuits which provide the necessary voicing to produce different orchestral effects on different notes. The resulting orchestral effect can be enhanced from an ensemble standpoint by controlled detuning of the four output frequencies, both within the chordal relationship and relative to other tones of corresponding pitch nomenclature under control of the same master oscillator. The outputs of the voltage controlled gate and filter circuits are applied to at least 2 output channels to avoid electrical cancellations when two programmable counters are assigned to the same note but slightly detuned.

5 Claims, 28 Drawing Figures

| | Q3 | Q4 | Q5 | Q6 | D1 | D2 | D3 | D4 | D5 | D6 | D7 | D8 | | N | K |
|---|---|---|---|---|---|---|---|---|---|---|---|---|---|---|---|
| $\overline{T12}$ | 1 | 0 | 0 | 1 | 0 | 1 | 0 | 0 | 1 | 1 | 1 | 1 | | 268 | 1.0 |
| $\overline{T11}$ | 0 | 0 | 0 | 1 | 0 | 1 | 0 | 0 | 0 | 1 | 1 | 1 | | 284 | 1.0 |
| $\overline{T10}$ | 1 | 0 | 1 | 1 | 1 | 0 | 1 | 0 | 1 | 0 | 1 | 1 | | 301 | 1.0 |
| $\overline{T9}$ | 0 | 0 | 1 | 1 | 1 | 1 | 1 | 0 | 0 | 0 | 1 | 1 | | 319 | 1.0 |
| $\overline{T8}$ | 1 | 1 | 1 | 1 | 0 | 0 | 0 | 1 | 0 | 1 | 0 | 1 | | 338 | .83 |
| $\overline{T7}$ | 0 | 1 | 1 | 1 | 0 | 0 | 1 | 1 | 1 | 0 | 0 | 1 | | 358 | .83 |
| $\overline{T6}$ | 1 | 1 | 1 | 0 | 1 | 1 | 0 | 0 | 0 | 0 | 0 | 1 | | 379 | .83 |
| $\overline{T5}$ | 0 | 1 | 1 | 0 | 0 | 0 | 0 | 1 | 0 | 1 | 1 | 0 | | 402 | .70 |
| $\overline{T4}$ | 1 | 1 | 0 | 0 | 0 | 0 | 0 | 0 | 1 | 0 | 1 | 0 | | 426 | .70 |
| $\overline{T3}$ | 0 | 1 | 0 | 0 | 1 | 1 | 0 | 1 | 1 | 1 | 0 | 0 | | 451 | .60 |
| $\overline{T2}$ | 1 | 0 | 0 | 0 | 0 | 0 | 1 | 0 | 0 | 1 | 0 | 0 | | 478 | 60 |
| $\overline{T1}$ | 0 | 0 | 0 | 0 | 0 | 0 | 0 | 0 | 0 | 0 | 0 | 0 | | 506 | .60 |

| | $\overline{Q7}$ | Q9 | Q8 | | M |
|---|---|---|---|---|---|
| 06 | 1 | 0 | 0 | | 1 |
| 05 | 1 | 1 | 0 | | 2 |
| 04 | 1 | 1 | 1 | | 4 |
| 03 | 0 | 1 | 1 | | 8 |
| 02 | 0 | 0 | 1 | | 16 |
| 01 | 0 | 0 | 0 | | 32 |

Q6
Q5
Q4
Q3
FF6
FF5
FF4
FF3
J
CK
K
Q
Q̄
QA
QB
120
122
124
126
11
CK2
CK2
T1
T2
T3
T4
T5
T6
T7
T8
T9
T10
T11
T12

D1 D2 D3 D4
D5 D6 D7 D8
Q7 Q8 Q9
CLE1 CLE2
CLE 3
CLE H
MFI
1D 2D 3D
1Q 2Q 3Q
G
1D 2D 3D 4D
1Q 2Q 3Q 4Q
CK C/L
Q4
J CK K
Q Q̄
+5V
1K
178K
53.3K
120K
240K
480K
480K
.01μf
470pf
271
272
328
280
282
284
286
288
290
292
294
302
303
305
306
307
308
309
310
312
314
316
318
320
322
324
326

VARIABLE FREQUENCY GENERATOR FOR POLYPHONIC ELECTRONIC MUSIC SYSTEM

BACKGROUND OF THE INVENTION

1. Field of the Invention

The present invention relates to a polyphonic electronic music system which provides output tone signals that can be either musically independent or in combination with conventional organ accompaniment, or the system can provide the background or accompaniment to conventional organ solo voices. The present invention further relates to techniques for producing orchestral chord tone signals that are slightly detuned to provide a fuller, richer more realistic ensemble effect.

2. Description of the Prior Art

Upon activation of a single key, it is old in the organ art to produce simultaneously, by stop selection, tones of different timbre and the same pitch, or by coupler selection, different octavely or harmonically related frequencies in the same timbres, or both of these at the same time.

It is also old for keys of different notes played simultaneously on different manuals of an organ to produce different timbres depending upon the particular stops selected on the different manuals.

Furthermore various key-switching circuits have been devised to associate the frequency of a tone oscillator with the highest or the lowest key played. For example in U.S. Pat. No. 3,801,721 — Bunger discloses a circuit arrangement for assigning position priority to the highest pitch key of a set of actuated keys. Dual oscillator key-switching systems have been designed to respond to the highest and the lowest keys played. However, when the position priority key-switching methods are extended to larger numbers of notes played, the switching becomes very cumbersome both mechanically and electrically.

Various multiplexing techniques have been used to reduce the wiring complexity between the playing key switches and the gating circuits which control the flow of tone signals. Examples include U.S. Pat. Nos. 3,746,773 — Uetrecht and 3,916,750 — Uetrecht. Time priority systems have also been devised for assigning a plurality of tone frequency means to keys in the order in which they are played in time as in U.S. Pat. No. 3,610,799 — Watson. However, the individual tones of chord notes played on the same keyboard or manual have generally been heard in the same timbre or timbres in contrast to the present invention. It is believed to be a unique advance in the art to provide a polyphonic electronic music system capable of automatically providing orchestral chord tonal outputs with different voices for different notes in a complex chord, and of automatic doubling of different voices on the same note when the chord becomes less complex in order to continue the ensemble effect.

BRIEF DESCRIPTION OF THE INVENTION

A polyphonic electronic music system in accordance with the present invention for use in an electronic musical instrument comprises a clock means for providing a plurality of clock outputs, a counter and decoder means for counting the clock pulses and decoding the counter outputs into a first set of time division logic signals representative of twelve notes of an octave, a second set of time division logic signals representative of two or more octaves, and a third set of time division logic signals representative of at least two manuals of keys of the electronic musical instrument. Multiplexer means is provided for transmitting certain ones of the first set of time division logic signals representative of the actuated key switches of the at least two manuals. Decoder and multiplexer means are provided for receiving the logic signals representative of the actuated key switches, the second set of logic signals, and the third set of logic signals and providing a serial train of time division multiplex logic signals identifying the actuated key switches. Memory means are provided for storing the serial train of logic signals representative of the actuated key switches for one cycle of the clock means. Comparator means is provided for comparing the serial train stored in the memory with the next serial train of logic signals representative of the then actuated key switches during the next cycle of the clock means and providing an enabling signal when the stored serial train corresponds to the next serial train. Priority selector means is provided for providing time division logic signals representative of the three lowest notes and the highest note of the actuated key switches. Monostable and enable logic means is provided for receiving the enabling signal from the comparator means, and the logic signals from the priority selector means and providing in response thereto output logic signals representative of the number of actuated keys and logic signals representative of the lowest three notes and the highest note of the actuated keys.

Programmable counter means is provided for receiving the logic signals from the monostable and enable logic means representative of the actuated keys, the first set of logic signals representative of the twelve notes of an octave, and logic signals representative of the two or more octaves and in response thereto producing slightly detuned output tone signals corresponding to the lowest three notes and the highest note of the actuated key switches, and voltage signals representative of the lowest three notes and the highest note of the actuated key switches.

Also provided are voltage control gate and filter means for wave shaping the output tone signals from the programmable counter means to produce desired voicing characteristics. An output system is provided for converting the wave shaped tone signals into audible sound.

The programmable counter means may comprise first, second, third and fourth programmable counters each of which receives a respective master frequency and divides that respective master frequency by a variable number determined by the logic signals from the monostable and enable logic means to produce tone signals representative of the actuated key switches. The monostable and enable logic means may provide logic signals to the first, second, third, and fourth programmable counters such that if only one key switch is actuated, the third and fourth programmable counters receive logic signals representative of the note of the key switch. If two key switches are actuated, the first and second programmable counters receive logic signals representative of the lower note, and the third and fourth programmable counters receive logic signals representative of the higher note of the actuated key switches. If three or more key switches are actuated, the first programmable counter receives a logic signal representative of the lowest note, the second programmable counter receives a logic signal representative of the second lowest note, the third programmable counter receives a logic signal representative of the third lowest note, and the fourth programmable counter receives a logic signal representative of the highest note of the actuated key switches.

The tone signals produced by the programmable counters are fed to pulse gate and voicing circuits which shape and filter the tone signals to produce the desired voices. The frequency generator which supplies the respective master frequency signals to the programmable counter means comprises a master frequency clocked generator means for providing master clock frequency signals. Also provided is a vibrato signal means for providing first signals that vary in frequency at a rate dependent upon the number of keys played. An ensemble signal means is also included for providing second signals the frequency of which varies dependent upon the time elapsed since the first key was played, the number of keys played and the highest note of the keys played. Frequency shifting means is included for receiving the master clock frequency signals, the first signals, and the second signals and producing a plurality of output tone signals which vary in frequency with respect to one another in response to variation of the first and second signals.

Thus, it is a principal object of the present invention to provide a frequency generator for a keyboard electronic musical instrument which generates multiple master tone signals that may be dynamically shifted in frequency with respect to one another depending upon the time elapsed since the first key was played, the number of keys played and the highest note key played.

These and other objects, advantages, and features shall hereinafter appear, and for the purposes of illustration, but not for limitation, an exemplary embodiment is illustrated in the accompanying drawings.

DETAILED DESCRIPTION OF THE PREFERRED EMBODIMENT

Figure 1:
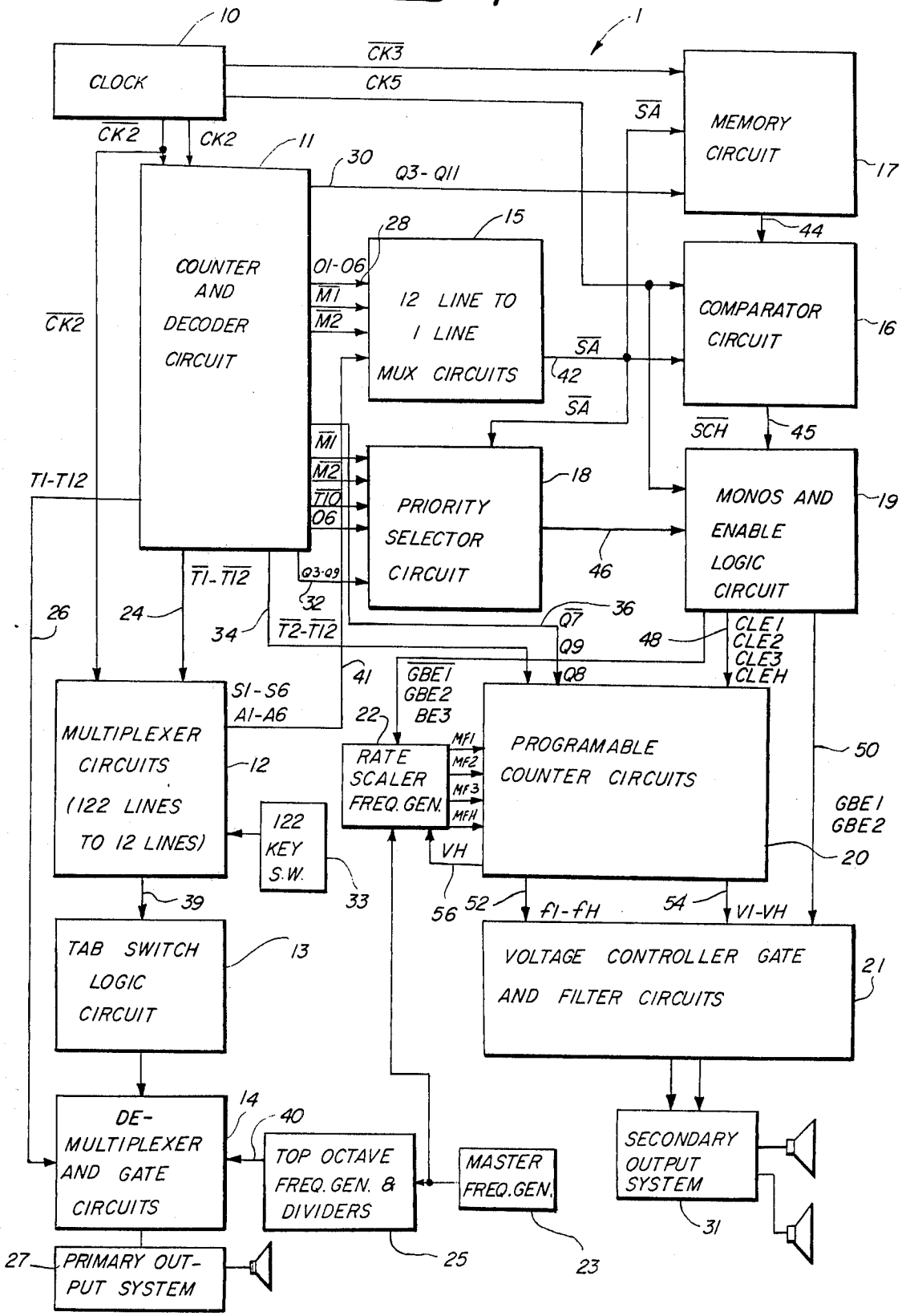
FIG. 1 is a block diagram of a polyphonic electronic music system in accordance with the present invention.
Figure 8A:
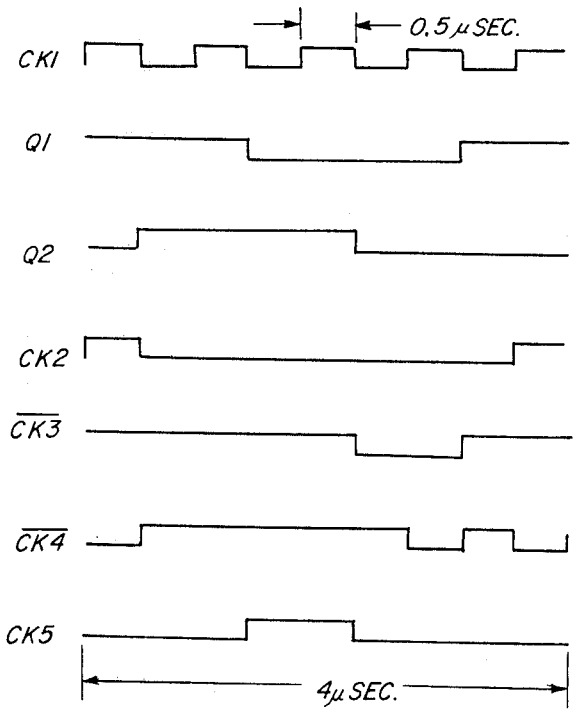
FIG. 8A is a diagram of the digital logic pulses developed by the clock 10 for a period of four microseconds.

With reference to FIG. 1, a block diagram of the preferred embodiment a polyphonic electronic music system 1 in accordance with the present invention is illustrated. A clock 10 includes a one megahertz oscillator and produces various clock outputs of varying duty cycles and phases at 250 KHz as illustrated in FIG. 8A. The CK2 and $\overline{CK2}$ outputs are connected to counter and decoder circuit 11. The $\overline{CK2}$ output is also connected to multiplexer circuits 12. The $\overline{CK3}$ clock is connected to memory circuit 17 and CK5 output is connected to comparator circuit 16 and monostable and enable logic circuit 19 to control its operation.

Figure 8B:
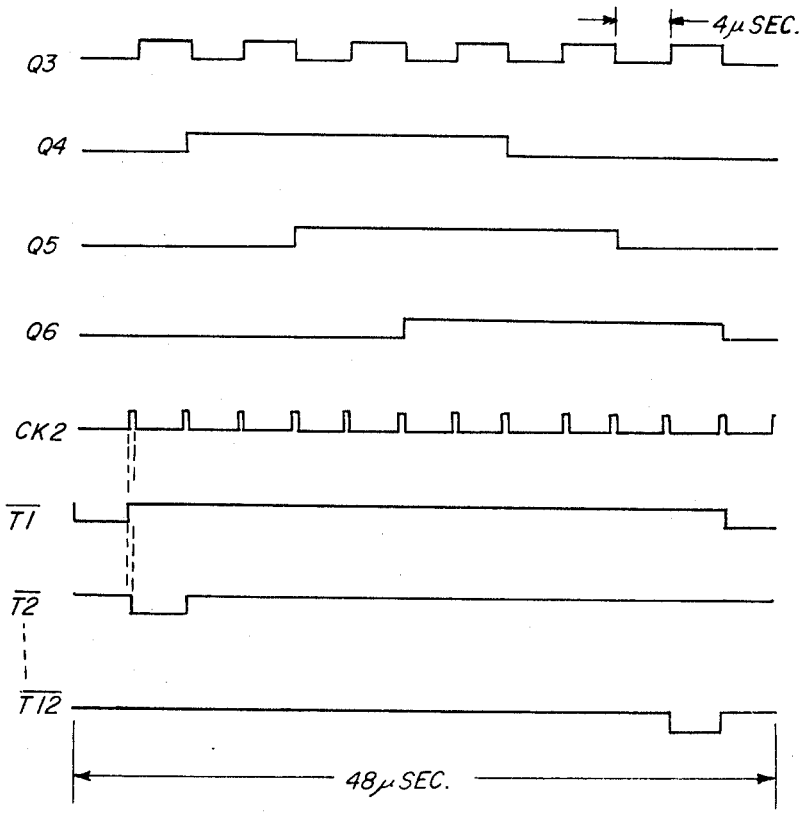
FIG. 8B is a diagram of the digital logic pulses produced by the counter and decoder circuit 11 for a period of 48 microseconds.

Counter and decoder circuit 11 is clocked by CK2 and $\overline{CK2}$. $\overline{CK2}$ is counted by a count by twelve flip-flop circuit and decoded into twelve sequential pulses T1 through T12 and their complements $\overline{T1}$ through $\overline{T12}$ (see FIG. 8B). The T pulses have a guard band of one eighth duty cycle imposed by the CK2 pulse from clock 10 so that there is no overlap between any of the pulses T1–T12. $\overline{T1}$–$\overline{T12}$ are connected to multiplexer circuits 12 by twelve separate lines 24. T1–T12 are connected to the demultiplexer and gate circuits 14 by twelve separate lines 26. Counter and decoder circuit 11 also divides $\overline{CK2}$ into six sequential pulses 01–06. The period of each of the 01–06 pulses spans the T1 through T12 sequence of pulses. The 01–06 data pulses are applied on six separate lines 28 to multiplexer circuit 15. Counter and decoder circuit 11 also produces two data pulses $\overline{M1}$ and $\overline{M2}$ each of which encompass the entire sequence of octave time pulses 01–06. $\overline{M1}$ and $\overline{M2}$ time pulses represent the selected manual of the organ. $\overline{M1}$ and $\overline{M2}$ are applied to octave multiplexing circuit 15 as well as to priority selector circuit 18. A nine bit word Q3–Q11 produced by counter and decoder circuit 11 is applied on nine separate leads 30 from counter and decoder circuit 11 to memory circuit 17. Seven bits, Q3–Q9, are applied on seven different leads 32 to priority selector circuit 18. Also, time slot pulse $\overline{T10}$ and octave time slot pulse 06 are applied to priority selector circuit 18 to decode the seventieth time slot (i.e., the 10th note of the sixth octave). The data pulses $\overline{T2}$–$\overline{T12}$ are connected by eleven separate leads 34 to programmable counter circuits 20. A three bit word produced by counter and decoder 11 comprising $\overline{Q7}$, Q9 and Q8 is connected by three separate leads 36 to the programmable counter circuits 20. $\overline{Q7}$, Q9 and Q8 encode the octave time slots 01–06 and are used by the programmable counter circuits to decode the octave of the played keys.

Multiplexer 12 encodes the notes played by the two sets sixty-one key switches 33 representing two manuals or keyboards into a time division multiplex logic signal on lead 39 connected to tab switch logic circuit 13. The tab switch logic circuit 13 directs each octave of encoded key switch data obtained from multiplexer circuit 12 into the appropriate octave demultiplexer and gate circuits 14. Tab switch logic circuit 13 and demultiplexer and gate circuits 14 are conventional and operate in substantially the same manner as illustrated and described in applicant's U.S. Pat. Nos. 3,746,773 and 3,916,750. The T1–T12 data on lead 26 to demultiplexer and gate circuit 14 is utilized to decode the input from the tab switch logic circuit 13 into the corresponding played notes. The output of demultiplexer and gate circuits 14 is applied to a conventional primary output system 27 (including filters, an amplifier and loud speaker).

A master frequency generator 23 is connected to a top octave frequency generator and dividers 25 which produce tone signals for all 96 notes of the organ which are applied on 96 leads 40 to the demultiplexer and gate circuit 14. Frequency generators 23 and 25 are conventional and may be similar to those illustrated in applicant's U.S. Pat. No. 3,816,635. Master frequency generator 23 is also connected to a rate scaler frequency generator 22 which produces four output frequencies MF1, MF2, MF3, and MFH which are applied to the programmable counter circuits 20. A control voltage Vh is connected via line 56 from the counter circuits 20 to the rate scaler frequency generator 22 for the purpose of slightly varying its output frequencies MF1, MF2, MF3, and MFH.

Multiplexer 12 provides time division multiplex signals on twelve separate leads 41 representative of played key switches 33. Six of the leads correspond to the six octaves of the solo manual (S1–S6) of the organ and the other six leads correspond to the six octaves of the accompaniment manual (A1–A6) of the organ. These twelve leads are connected to the multiplexer circuit 15 which decodes this data along with 01–06 and $\overline{M1}$ and $\overline{M2}$ data to produce a sequential time division multiplex output signal train $\overline{SA}$ on a single lead 42. $\overline{SA}$ contains data representative of the particular notes played and the manual in which these notes are located. $\overline{SA}$ is directed to memory 17 where the data is stored for one cycle to be compared with $\overline{SA}$ data on the next occurrence of the $\overline{CK3}$ clock to determine whether there has been any change in the played keys from one cycle of the clock to the next. Comparator 16 receives the $\overline{SA}$ data stored by memory 17 on the previous cycle on lead 44 and upon the occurrence of the CK5 clock signal, compares that data with the $\overline{SA}$ data on lead 42 for the present cycle. If the data has not changed, a logic signal identified by the mnemonic $\overline{SCH}$ is applied on lead 45 to the monstable and enable logic circuit 19 to indicate that there has been no change in the keys played.

The priority selector circuit 18 decodes $\overline{SA}$, $\overline{M1}$, $\overline{M2}$, $\overline{T10}$ 06, Q3–Q9 to produce on eleven leads 46 connected to monostable and enable logic circuit 19 data representative of the lowest three notes and the highest note played. The monostable and enable logic circuit 19 decodes the information on leads 46 to produce on four leads 48 logic information designated CLE1, CLE2, CLE3, and CLEH representative of three lowest notes played and the highest note played. Monostable and enable logic circuit 19 also produces on two leads 50 information designated GBE1 and GBE2 representative of the number of notes that have been played.

The programmable counter circuits 20 receive the CLE1 through CLEH information which is converted to four frequency outputs f1-fH on four leads 52. The four programmable counter circuits 20 also produce on four leads 54 four separate voltages, V1, V2, V3, and VH which are representative of the frequency outputs f1-fH. VH is also applied by lead 56 to the rate scaler frequency generator 22 to control MF1 through MFH so that those frequencies change very slightly to detune the outputs f1-fH so that a richer orchestral effect is produced. The four frequencies f1-fH are applied to the voltage controlled gate and filter circuits 21. The output of the voltage controlled gate and filter circuits 21 is connected to a two channel secondary output system 31 (i.e., an acoustic radiating system including amplifiers and loudspeakers).

Figures 2, 10A, 10B:
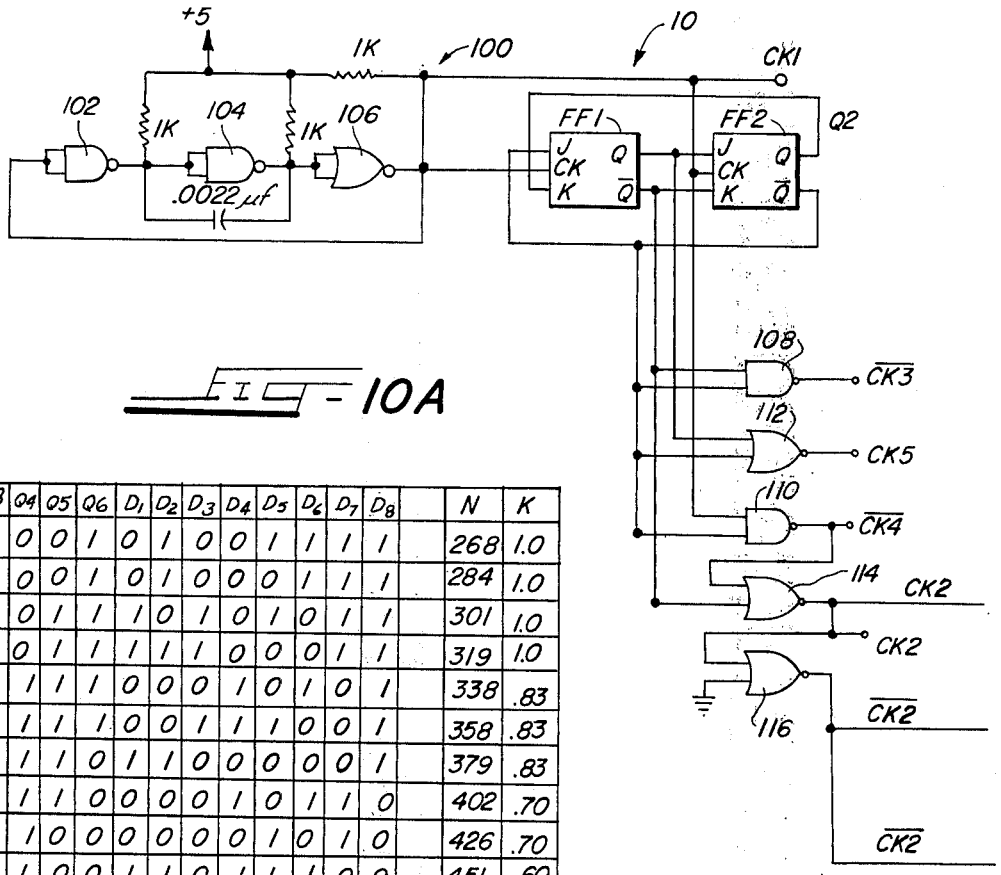
FIG. 2 is a more detailed schematic diagram of the system clock illustrated in FIG. 1.
FIG. 10A is a chart showing the truth table for the logic circuitry of the present invention.
FIG. 10B is a truth table for the octave data pulses 01–06.

With reference to FIG. 2, clock 10 comprises a conventional 1MHz oscillator 100 comprising NAND gates 102 and 104 and NOR gate 106 arranged to produce 1MHz at the CK1 output. The 1MHz CK1 output is connected to the clock (CK) inputs of JK flip-flops FF1 and FF2. The CK1 output and the respective Q1, $\overline{Q1}$, and $\overline{Q2}$ outputs of flip-flops FF1 and FF2 are connected as indicated to NAND gates 108 and 110 and NOR gates 112, 114, and 116 which act to decode these outputs to produce clock outputs CK2, $\overline{CK3}$, $\overline{CK4}$, CK5, and $\overline{CK2}$. FIG. 8A illustrates the time relationship of the various clock outputs CK1, CK2, $\overline{CK3}$, $\overline{CK4}$, and CK5.

The $\overline{CK2}$ output from NOR gate 116 is applied to the clock input of flip-flop FF3 (see FIG. 3) of counter and decoder circuit 11. The CK2 output of NOR gate 114 is also connected to one of the inputs of each of NOR gates 120 and 122 in counter and decoder circuit 11. The $\overline{Q3}$ output of FF3 is connected to the other input of NOR gate 122 and the Q3 output of FF3 is connected to the input of NOR gate 120 and also to the clock (CK) inputs of JK flip-flops FF4, FF5, and FF6. The Q output of flip-flop FF4 is labelled Q4, the Q output of FF5 is labelled Q5, and Q the output of FF6 is labelled Q6. The purpose of these outputs will be described later.

The output of NOR gate 120 is labelled QA and the output of NOR gate 122 is labelled QB. The Q and $\overline{Q}$ outputs of FF4, FF5, and FF6 are encoded by 12 NAND gates 124 to produce 12 logic outputs labelled $\overline{T1}$ through $\overline{T12}$ which, with reference to FIG. 8B can be seen to be 12 sequential pulses having a slightly reduced duty cycle so that there is a guard band between each of the pulses T1 through T12 separating the pulses so that there is no overlap. The guard band separating the pulses is imposed by the CK2 pulse applied to NOR gates 120 and 122. QA and QB are applied to alternate NAND gates 124 so that the end of each T pulse is brought to logic one when CK2 goes to logic one. Thus, there is no overlap between the adjacent $\overline{T}$ and T pulses.

Counter and decoder circuit 11 also comprises twelve inverters 126 which invert the $\overline{T1}$–$\overline{T12}$ pulses to positive true T1–T12. T1–T12 are applied to the demultiplexer and gate circuits 14 to provide time position signals to the demultiplexer and gate circuits 14 in the same manner as described in applicant's U.S. Pat. Nos. 3,746,773 and 3,916,750.

Figures 2, 3, 4, 5, 6, 7A, 7B, 7C, 7D, 11, 12, 13:
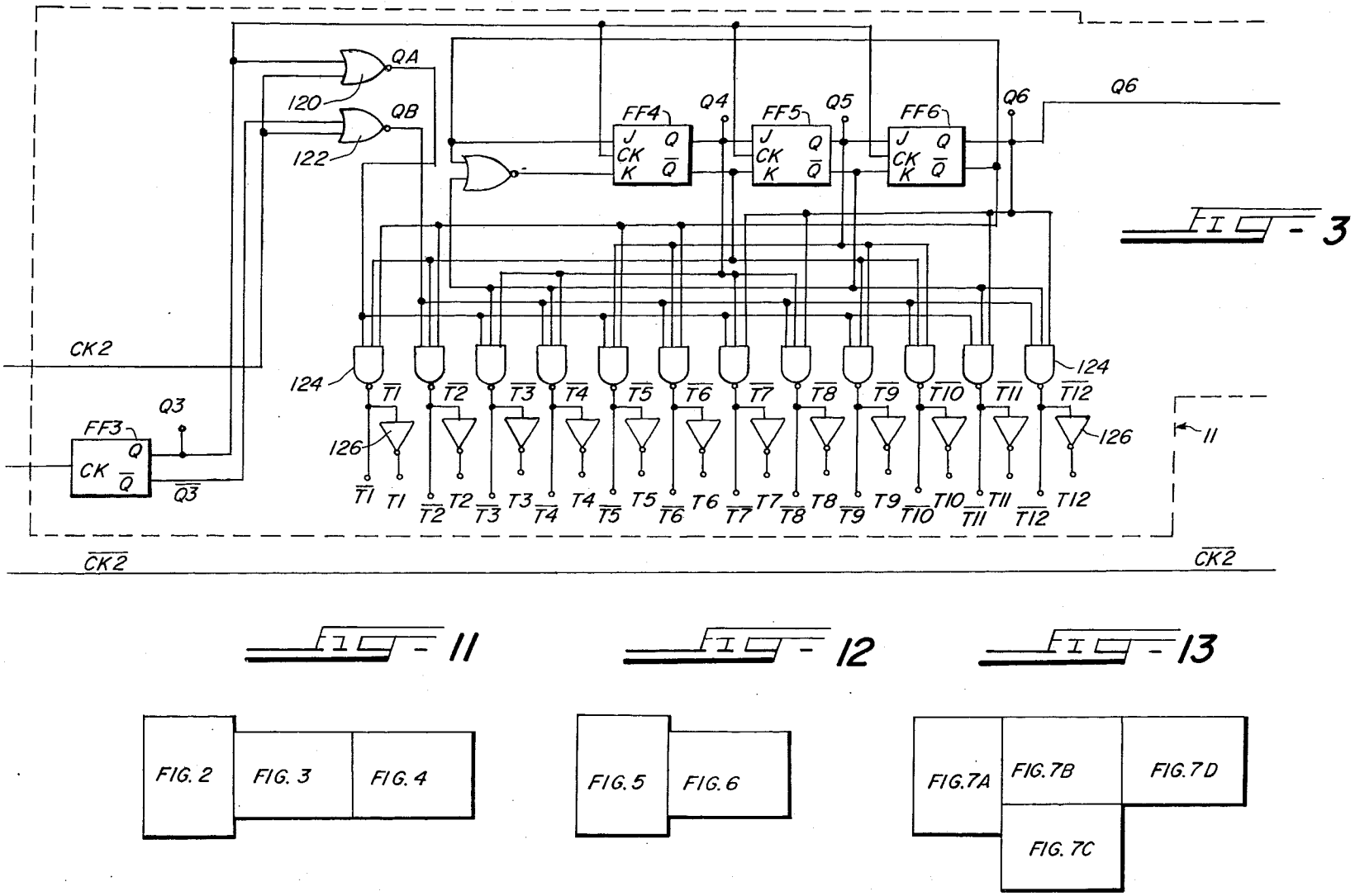
FIG. 3 is a more detailed schematic diagram of a portion of the counter and decoder circuit illustrated in FIG. 1.
FIG. 4 is a more detailed schematic diagram of a portion of the counter and decoder circuit, and the multiplexer circuits 12 and 15 illustrated in FIG. 1.
FIG. 5 is a detailed circuit diagram of the priority selector circuit illustrated in FIG. 1.
FIG. 6 is a detailed circuit diagram of the memory circuit, comparator circuit, and monostable and enable logic circuit illustrated in FIG. 1.
FIGS. 7A, 7B, 7C, and 7D are detailed circuit diagrams of the programmable counter circuits illustrated in FIG. 1.
FIG. 11 is a diagram showing the orientation of FIGS. 2, 3, and 4.
FIG. 12 is a diagram showing the orientation of FIGS. 5 and 6.
FIG. 13 is a diagram showing the orientation of FIGS. 7A, 7B, 7C and 7D.
Figure 4:
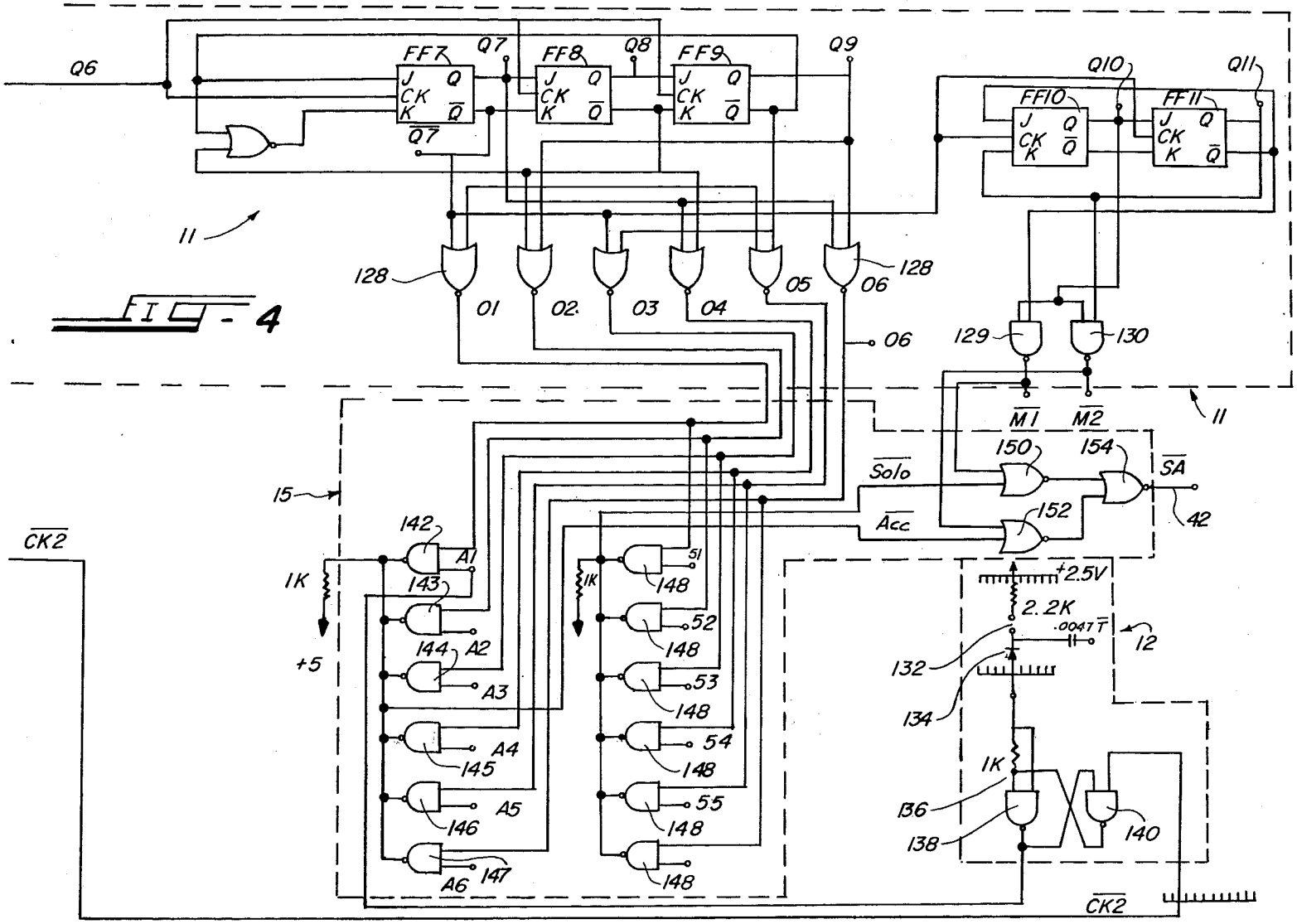
Figure 5:
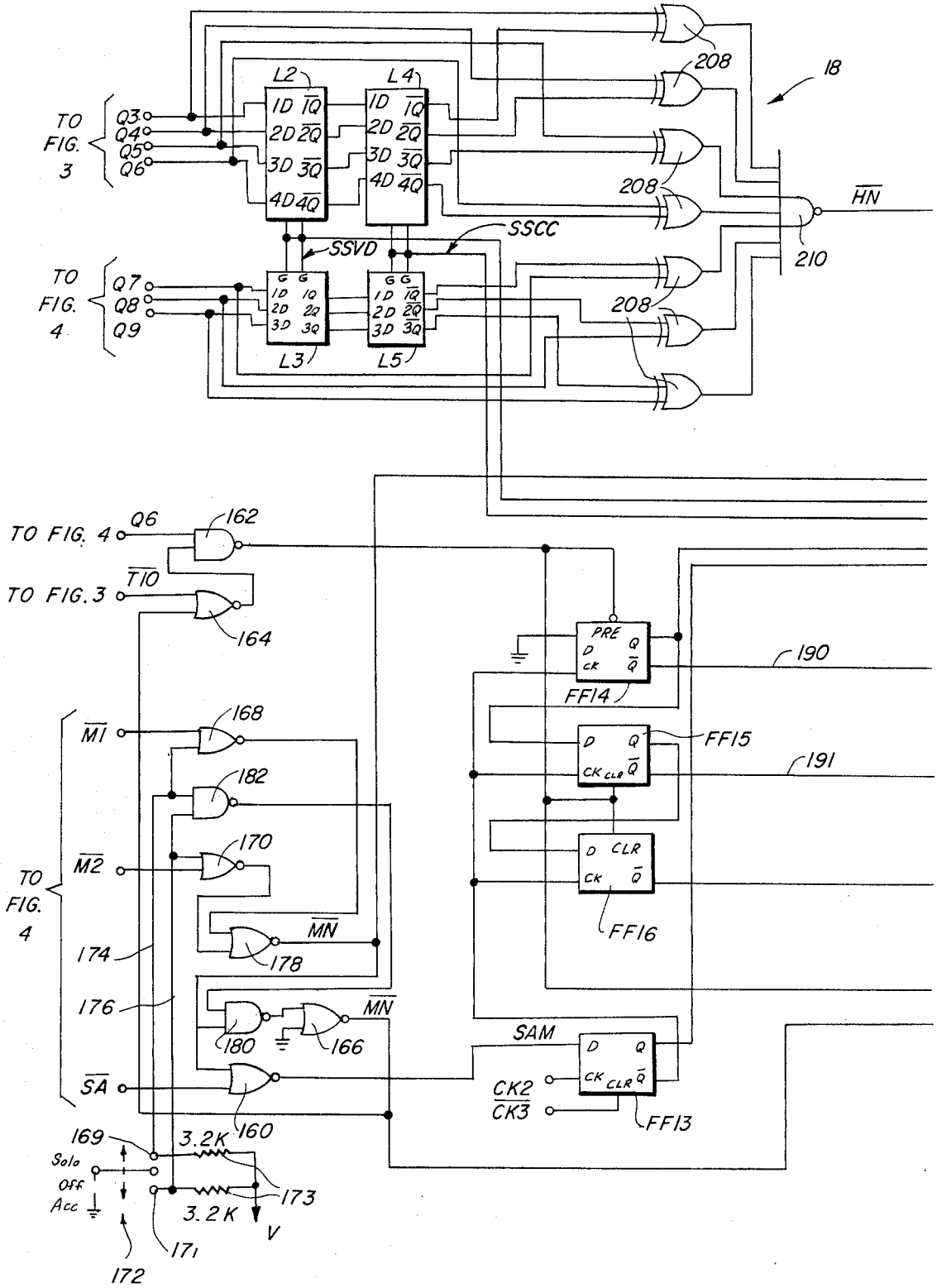
Figure 6:
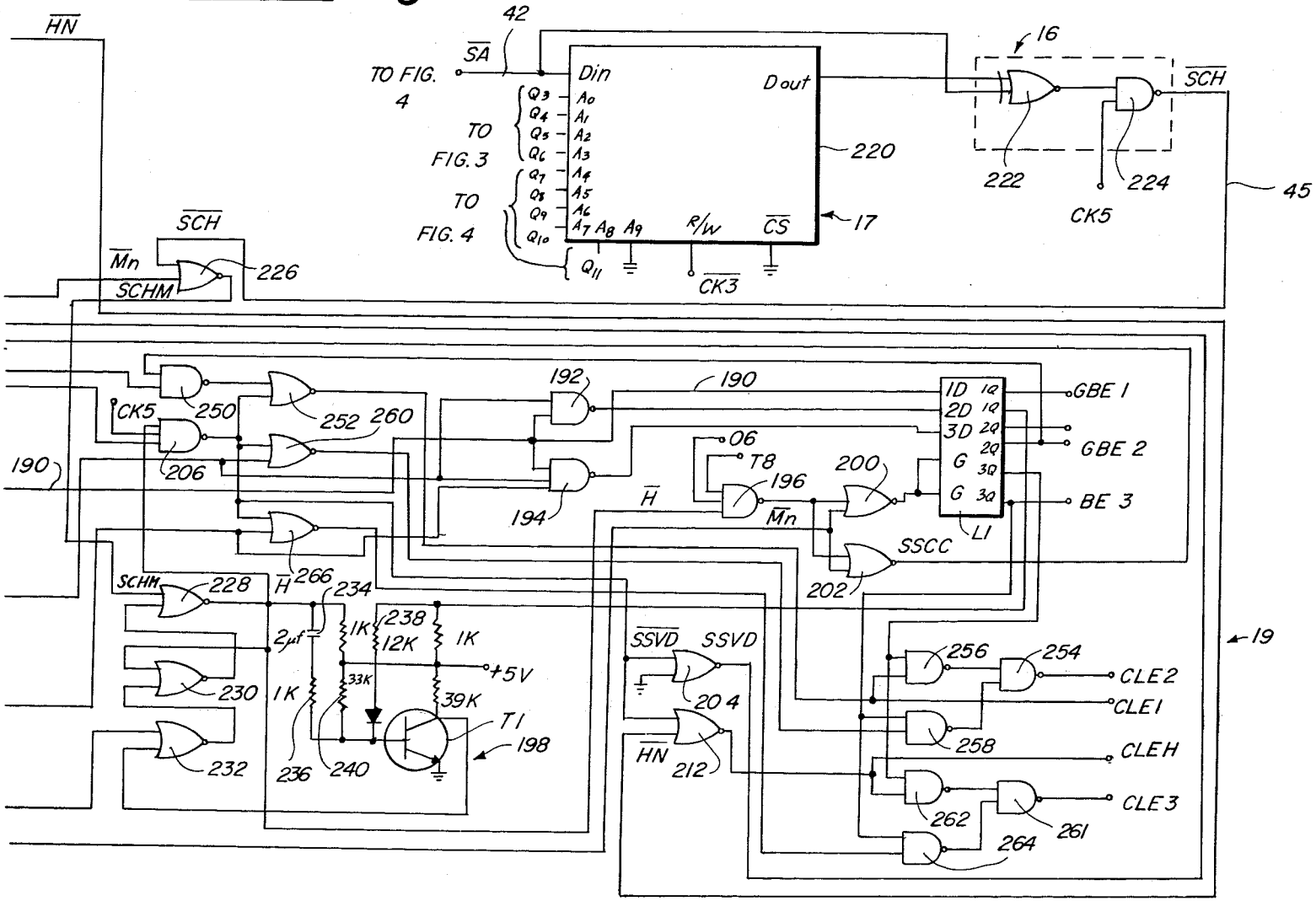
Figure 7A:
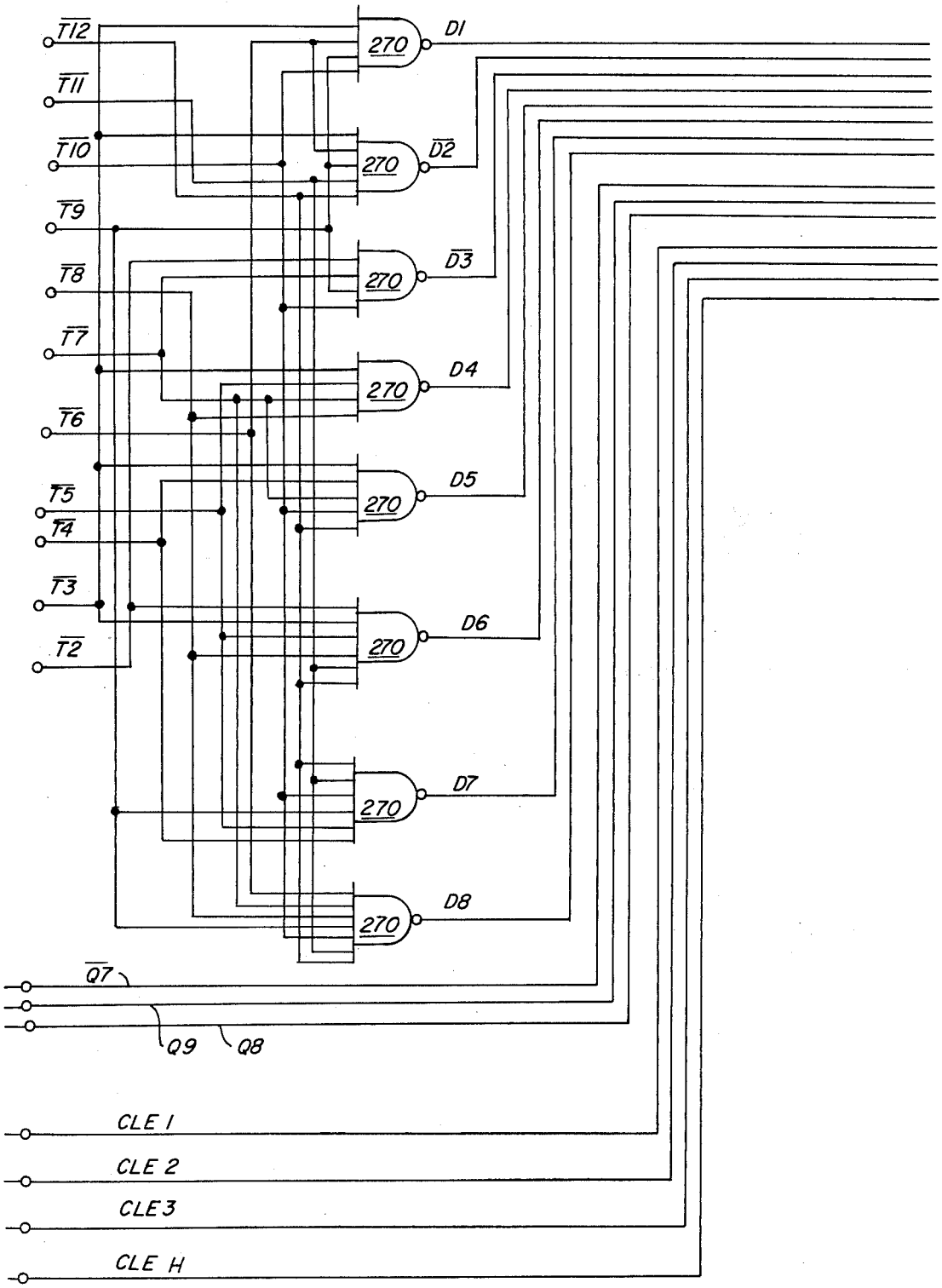
Figure 7B:
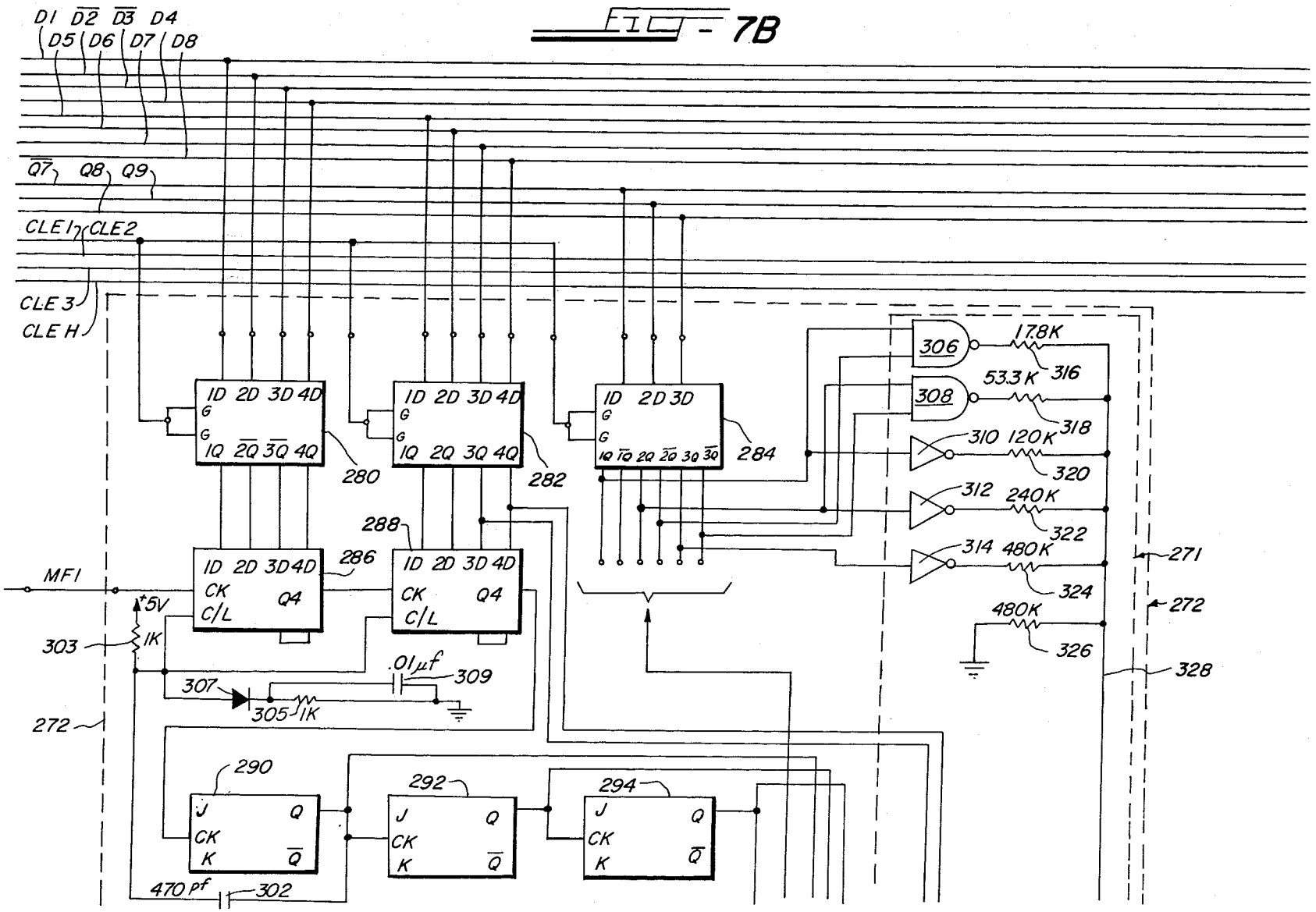
Figure 7C:
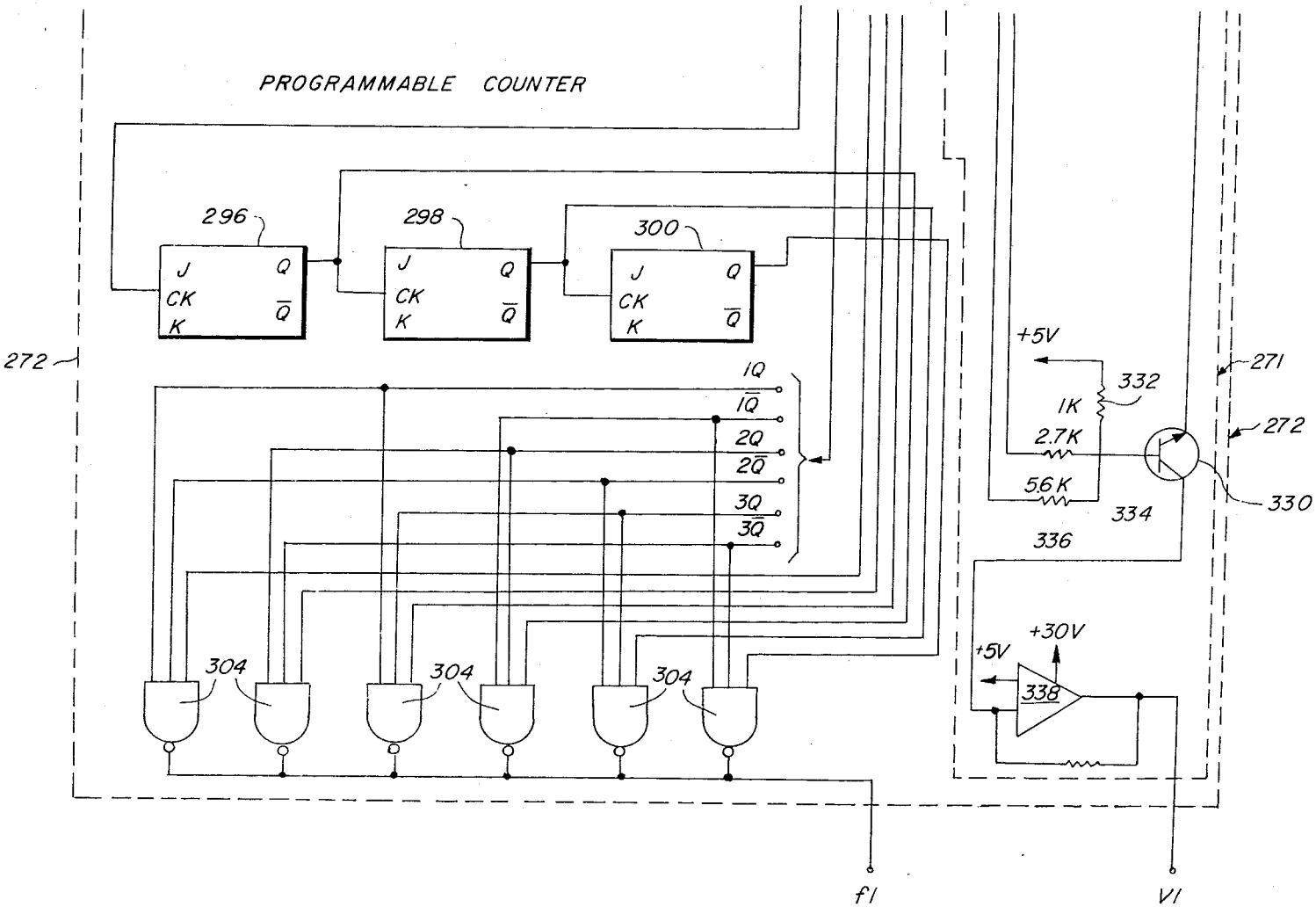
Figure 7D:
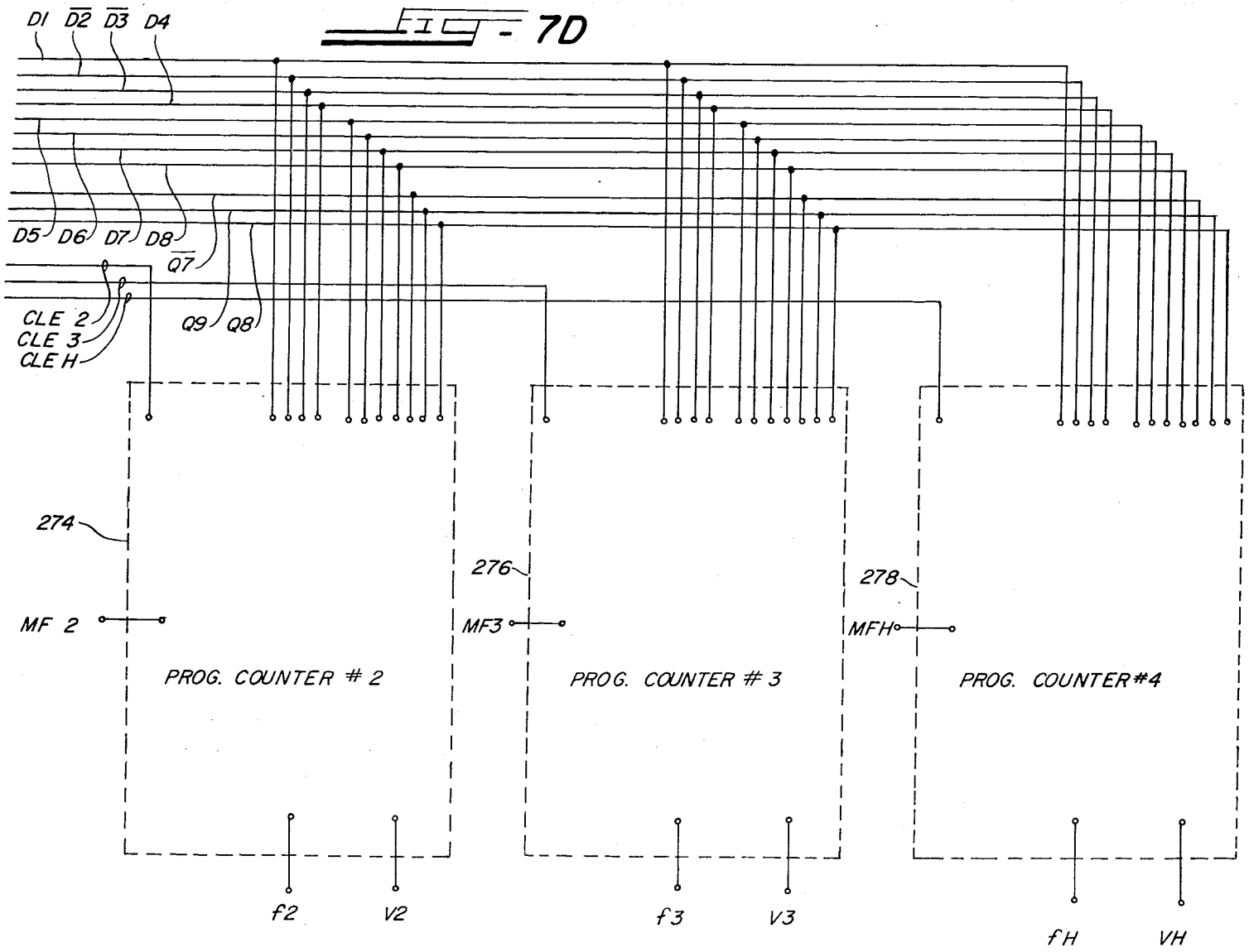
Figure 9A:
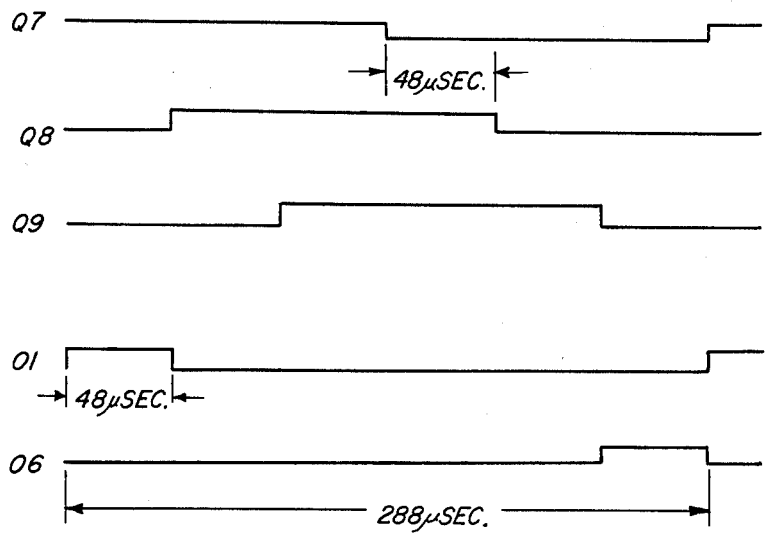
FIG. 9A is a diagram of the digital logic pulses of the counter and decoder circuit 11 for a period of 288 microseconds.

The Q6 output of FF6 is connected to the clock (CK) inputs of JK flip-flops FF7, FF8, and FF9 (see FIG. 4). The Q outputs of FF7, FF8, and FF9 are respectively labelled Q7, Q8, and Q9. The Q and $\overline{Q}$ outputs of FF7, FF8 and FF9 are decoded by 6 NOR gates 128 to produce 6 sequential pulses 01 through 06, each having a period of 48 micro-seconds encompassing the period of $\overline{T1}$ through $\overline{T12}$. (see FIGS. 9A and 8B). Sequential periods 01 through 06 represent the octave time slots of the time division multiplex signal as will be hereinafter more fully described. Thus, for each 0 time slot the entire sequence of $\overline{T}$ pulses ($\overline{T1}$–$\overline{T12}$) occurs.

Figure 9B:
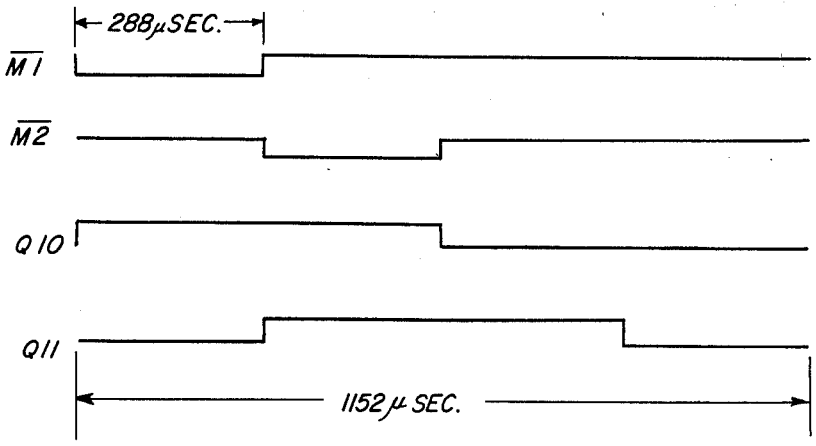
FIG. 9B is a diagram of the digital logic pulses of the counter and decoder circuit 11 for a period of 1.152 milliseconds.

The $\overline{Q7}$ output of FF7 connected to the clock (CK) input of JK flip-flops FF10 and FF11 which produce at their Q outputs Q10 and Q11 logic signals. Q10 and Q11 are decoded by NAND gates 129 and 130 to produce each of their respective outputs $\overline{M1}$ and $\overline{M2}$ time division multiplex signals (see FIG. 9B). $\overline{M1}$ represents the time slot for the solo manual of the organ and $\overline{M2}$ represents the time slot for the accompaniment manual of the organ. As can be seen $\overline{M1}$ and $\overline{M2}$ each encompass 01 through 06 so that seventy two $\overline{T}$ time slots (6×12) are included in each $\overline{M1}$ and $\overline{M2}$ time slot. This is more than enough time slots to cover the notes of an organ manual.

Illustrated in the lower right hand corner of FIG. 4 is a partial representation of multiplex circuit 12 for one octave of twelve total octaves of the organ. Multiplexer 12 comprises 12 similar circuits (only one of which is shown) each of which include twelve key switches 132 (only one of which is shown) for each semitone of the octave connected in series with the cathode twelve diodes 134 (only one of which is shown). Switches 132 are connected in parallel to a 2.5 volt source, and the anodes of all twelve diodes 134 are connected in parallel to one side of a 1K resistor 136. Resistor 136 is connected to one input of a NAND gate 138 and the other input to NAND gate 138 is connected to diodes 134. The output of NAND gate 138 is connected to one input of NAND gate 140, and the other input of NAND gate 140 is connected to the $\overline{CK2}$ output of clock 10 (FIG. 2). Similarly, $\overline{CK2}$ is connected to a similar NAND gate arrangement in each of the other twelve octave multiplexer circuits for the solo and accompaniment manuals. Connected between each of the switches 132 and diodes 134 is a 0.0047 micro farad capacitor in series with one of the $\overline{T1}$–$\overline{T12}$ outputs of counter and decoder circuit 11 in FIG. 3. Thus, each of the twelve key switches representing one semitone of the octave is connected to a different $\overline{T}$ output of counter and decoder 11 so that each time a key switch is closed, a $\overline{T}$ pulse representative of the time slot of that particular note is applied to NAND gate 138. NAND gates 138 and 140 act as an RS flip-flop to clean up the output signal to assure that regardless of the noise level of the circuit, the $\overline{T}$ output is latched until the $\overline{CK2}$ output goes negative (at the end of each $\overline{T}$ pulse) and resets the RS flip-flop.

The multiplexer 12 illustrated in FIG. 4, corresponds to one octave to the accompaniment manual of the organ. The output of NAND gate 138 is connected to the A1 input of NAND gate 142 in multiplexer circuit 15. The other input of NAND gate 142 is connected to the 01 (first octave) output from NOR gates 128 in counter and decoder circuit 11. Similarly, NAND gates 143–147 are respectively connected at one input to 02, 03, 04, 05 and 06 outputs and the other input is connected to the second, third, fourth, fifth, and sixth accompaniment octave multiplexer circuits (not shown) at inputs A2, A3, A4, A5, and A6 to produce a time division multiplex signal identified $\overline{ACC}$ corresponding to the keys played on the accompaniment manual. Similarly, six NAND gates 148 receive six octaves of solo manual T inputs which are NANDed with 01–06 to provide a time division multiplex signal identified $\overline{Solo}$ corresponding to the keys played in the solo manual. The output of the accompaniment manual NAND gates 142–147 are combined on a single lead which is marked $\overline{ACC}$ which is connected to one input of NOR gate 152. The outputs of NAND gates 148 are combined on a single lead marked $\overline{Solo}$ which is connected to one input of NOR gate 150. The other input of NOR gate 150 is connected to the $\overline{M1}$ output of NAND gate 129, and the $\overline{M2}$ output of NAND gate 130 is connected to the other input of NOR gate 152. The output of NOR gates 150 and 152 are connected to the inputs of NOR gate 154, and NOR gate 154 produces at its output on lead 42 a time division multiplex serial digital logic train of signals representative of the note, octave, and manual of the actuated key switches. This output signal of NAND gate 154 is identified by the mnemonic $\overline{SA}$. It can be seen that the combination of signals 01–06 and signals $\overline{T1}$–$\overline{T12}$ combine to define 72 time slots (6 times 12) for each manual and a total of 144 time slots (2×72) for both the solo and accompaniment manuals, Thus, each key switch on the accompaniment and solo manual has a corresponding time slot which is identified by the serial digital logic train $\overline{SA}$.

With reference to FIGS. 5 and 6, the Q3–Q6 inputs in the upper lefthand corner of FIG. 6 are connected to the same marked outputs in FIG. 3 and Q7–Q9 are connected to the corresponding outputs of FIG. 4. The input identified $\overline{SA}$ in FIG. 6 is connected to the corresponding $\overline{SA}$ output of NOR gate 154 in FIG. 4. The $\overline{SA}$ serial data train is applied to NOR gate 160 which gates $\overline{SA}$ to the data (D) input of flip-flop FF13. The clock (CK) input of FF13 is connected to CK2 output of clock 10 (FIG. 2). Thus, the $\overline{SA}$ data train is clocked through FF13 by CK2 but each bit of data is delayed one time slot (since CK2 occurs at the end of each $\overline{T}$ pulse) to synchronize the frequencies produced by the top octave frequency generator and dividers 25 with the outputs from the programmable counters 20 as will be more fully described below.

The 06 output from NOR gates 128 in FIG. 4 is applied to one input of NAND gate 162. The other input of NAND gate 162 receives the output of NAND gate 164. Applied to one input of NAND gate 164 is the $\overline{T10}$ output from counter and encoder circuit 11 in FIG. 3, and the other input of NAND gate 164 receives Mn logic data from NOR gate 166 which is the negative true logic for the selected manual ($\overline{M1}$ or $\overline{M2}$). Thus, NAND gate 162 and NOR gate 164 follow the Boolean logic equation $(\overline{T10})\ (\overline{M})\ (\overline{06})$. This logic equation decodes time slot 70 for either the solo or the accompaniment manual (i.e., the tenth note of the sixth octave).

Time slots 1–61 are used to scan the keys for one manual during $\overline{M1}$, and then for the other manual during $\overline{M2}$. This information is delayed to time slots 2 through 62 by FF13 as noted above.

$\overline{M1}$ from NAND gate 129 in FIG. 4 is applied to the $\overline{M1}$ input to NOR gate 168 in FIG. 6. $\overline{M2}$ from NAND gate 130 in FIG. 4 is applied to the $\overline{M2}$ input to NOR gate 170 in FIG. 6. The other inputs of NOR gates 168 and 170 are respectively connected to solo and accompaniment switch contacts 169 and 171 in solo and accompaniment selector switch 172. Contacts 169 and 171 are respectively connected through 3.9k resistors 173 to an appropriate voltage source V to provide logic signals for NOR gates 168 and 170. As can be seen, when switch 172 is moved to the solo position, lead 174 is brought to logic zero but lead 176 remains at logic one. Thus, when $\overline{M1}$ goes to logic one, the output of NOR gate 168 goes to logic zero and when $\overline{M1}$ goes to logic zero, the output of NOR gate 168 goes to logic 1. Thus, NOR gate 168 acts as an inverter of the $\overline{M1}$ signal. At the same time, since lead 176 is at logic one, the output of gate 170 remains at zero irrespective of the $\overline{M2}$ logic state. The output of NOR gate 168 is applied to one input of NOR gate 178. The other input of NOR gate 178 is connected to the output of NOR gate 170. Thus, since the output of NOR gate 170 remains at logic zero while the switch 172 is in the solo position, NOR gate 178 acts as an inverter so that the output of NOR gate 178 is once again $\overline{M1}$. The output of NOR gate 178 is applied to one input of NAND gate 180, the other input of NAND gate 180 is connected to the output of NAND gate 182. NAND gate 182 is connected to the solo and accompaniment contacts 169 and 171 of switch 172. In the present hypothetical, since switch 172 is in the solo position, one input of NAND gate 182 is at logic zero and the other is at logic one. Thus, the output of NAND gate 182 is logic one. When switch 172 is in the off position both inputs of NAND gate 182 are at logic one. Accordingly, it can be seen that the output of NAND gate 182 is zero if switch 172 is off and logic one if switch 172 is in either the solo or accompaniment positions. Accordingly, NAND gate 180 operates to invert the output of NOR gate 178 only when switch 172 is in either the solo or accompaniment positions.

NOR gate 166 inverts the output of NAND gate 180 so that the output $\overline{Mn}$ goes to logic one when $\overline{M1}$ goes to logic one and to logic zero when $\overline{M1}$ goes to logic zero. Similarly, if switch 172 is moved to the accompaniment position, $\overline{Mn}$ goes to logic one when $\overline{M2}$ goes to logic one and to zero when $\overline{M2}$ goes to zero. As pointed out before, $\overline{Mn}$ is applied to NOR gate 164 to decode time slot 70 for the selected manual.

The output of NAND gate 162 is connected to the preset (PRE) input of flip-flop FF14 and the clear (CLR) inputs of flip-flops FF15 and FF16. Thus, at time slot 70, the Q outputs of flip-flops FF14, FF15, and FF16 are set to logic one, zero, zero (when no keys are being scanned). The serial multiplex data train $\overline{SA}$ is combined with manual time slot Mn to produce SAM data applied to the data (D) input of FF13. SAM is clocked through FF13 upon each CK2 clock pulse and cleared by each $\overline{CK3}$ pulse so that the data remains at the Q output only during the appropriate time slot. The $\overline{Q}$ output of FF13 is connected to the clock inputs of FF14, FF15 and FF16. Thus, the first serial data pulse representing a closed key switch is clocked through FF13, and at the trailing edge of this pulse, the Q outputs of FF14, FF15 and FF16 are closed to zero, one, zero respectively. The second data pulse of SAM representative of the next actuated switch clocks the Q outputs of FF14, 15, and 16 respectively to zero, zero, one. A third data pulse of SAM clocks the Q outputs of FF14, 15 and 16 to zero, zero, zero. The Q output of FF14 is directly connected by lead 190 to the first data (1D) input of integrated latch circuit L1. Latch circuit L1 is sold under the commercial designation 7475. The second data (2D terminal) of latch circuit L1 is connected to the output of NAND gate 192, one input of which is connected to the $\overline{Q}$ output of FF14 and the other input of which is connected by lead 191 to the $\overline{Q}$ output of FF15. The third data (3D) input of latch circuit L1 is connected to the output of NAND gate 194. The 3 inputs of NAND gate 194 are respectively connected to the $\overline{Q}$ outputs of FF14, FF15, and FF16. Thus, NAND gates 192 and 194 decode the Q outputs of FF14, FF15 and FF16. NAND gate 196 is connected to the 06 and T8 outputs and also receives $\overline{H}$ or key enable data from the monostable circuit 198 (which will be more fully described hereinafter).

The output of NAND gate 196 is connected to one input of NOR gate 200 the output of which is connected to the G or gate enable inputs of latch circuit L1. The other input of NOR gate 200 receives $\overline{Mn}$ data from NOR gate 166. Thus, it can be seen that at the 68th time slot (06-T8) of the selected manual ($\overline{Mn}$) the data inputs on the 1D, 2D, and 3D inputs of latch circuit L1 are gated to the Q outputs of latch circuit L1. If no keys have been played, the GEB1 (1Q) GEB2 ($2\overline{Q}$) and BE3 ($3\overline{Q}$) outputs of latch circuit L1 will be zero. These outputs follow the following logic equations GBE1 = 1D = $\overline{Q14}$, GBE2 = $\overline{2D}$ = ($\overline{Q14}$) ($\overline{Q15}$), BE3 = $\overline{3D}$ = ($\overline{Q14}$) ($\overline{Q15}$) ($\overline{Q16}$).

If one key is played, GBE1 goes to logic one and GBE2 and BE3 stay at logic zero. If two keys are played, GBE1 and GBE2 go to logic one and BE3 stays at logic zero. If three keys are played, GEB1, GEB2, and BE3 go to logic one.

NOR gate 202 also receives $\overline{Mn}$ data and the output of NAND gate 196 so that the logic output of NOR gate 202 designated SSCC (steady state cycle complete) is at logic one when 06, T8, $\overline{H}$, and Mn equal one. This logic corresponds to the unused time slot 68, the system not in hold, the manual being scanned corresponding to the manual to which the system is coupled, i.e., the appropriate manual selected by switch 172.

NOR gate 204 has one input grounded and the other input connected to the output of NAND gate 206. The output of NOR gate 204 is identified as steady state valid data (SSVD). SSVD equals logic one when Q13, $\overline{H}$, and CK5 equal one. This state corresponds to a played key being scanned, the system in steady state (not in hold), and the data is valid, i.e., CK5 equals one. CK5 goes to logic one at the center of each $\overline{T}$ time slot (See FIGS. 8A and 8B) so that data is valid only after initial transients have subsided.

The SSVD output of NOR gate 204 is connected to the G or gate enable inputs of integrated latch circuits L2 and L3. As previously pointed out, the inputs of L2 and L3 receive Q3–Q9 data. The SSCC data from NOR gate 202 is connected to the gate enable inputs of integrated latch circuits L4 and L5. Integrated latch circuits L2 through L5 are commercially available integrated circuits sold under the designation 7475. Flip-flops FF13–FF17 are integrated circuits sold under the designation 7474.

It can be seen, therefore, that each time the Q output of FF13 goes to logic one, i.e., at each time slot representative of a played key (delayed one slot by FF13), and the other conditions are satisfied, ($\overline{H}$=CK5=1), SSVD goes to logic one clocking the Q3 through Q9 data on the inputs of L2 and L3 through the latch circuits to the Q outputs of L2 and L3. This will occur each time a note is scanned until ultimately the Q3–Q9 data representative of the highest note played on the selected manual will be present at the Q outputs of L2 and L3. At the conclusion of the scan cycle, SSCC goes to logic one so that latch circuits L4 and L5 clock through to their outputs the data representative of the highest note played. Thus, information representative of the highest note played is present at the outputs of L4 and L5 at the completion of the cycle. This data is applied to a series of seven Exclusive OR gates 208. The outputs of Exclusive OR gates 208 are connected in parallel to the inputs of a NAND gate 210. The other inputs of Exclusive OR gates 208 are connected to the corresponding Q3–Q9 inputs as indicated. When the high note data latched by L4 and L5 is the same as the Q data on inputs Q3–Q9 on the next scan, the outputs of Exclusive OR gates 208 go to logic one simultaneously so the output of NAND gate 210 goes to logic zero. This state occurs only at the time slot representative of the highest note played. The output of NAND gate 210 identified $\overline{HN}$ is applied to one input of NOR gate 212 which decodes the CLEH (counter latch enable high) output. The other input of NOR gate 212 is connected to NAND gate 206 which decodes the Q output of FF13 during the CK5 and $\overline{H}$ equal to one state. CK5 goes to logic 1 approximately halfway in between CK2 pulses. Thus, CK5 clocks the Q output of FF13 through NAND gate 206 approximately halfway between successive clocks of FF13. Thus, the Q output of FF13 has had an opportunity to reach a steady state before that data is clocked through NAND gate 206. The output of NAND gate 206 is the complement of steady state valid data or $\overline{SSVD}$.

With reference to FIG. 6, memory 17 comprises an integrated circuit random access memory (RAM) sold under the commercial designation 2102. The $\overline{SA}$ data from FIG. 4 is also applied to the data (Din) input of RAM 220. The Q3 through Q11 outputs of flip-flops FF3 through FF11 (from FIGS. 3 and 4) are applied to the A0 through A8 inputs of RAM 220. The A9 input is grounded and the read/write (R/W) input is connected to the $\overline{CK3}$ clock output of clock 10 in FIG. 2. The data out (Dout) output of RAM 220 is connected to one input of Exclusive OR gate 222 in comparator circuit 16. The other input of Exclusive OR gate 222 is connected to $\overline{SA}$ lead 42. If $\overline{CK3}$ is logic one, RAM 220 is reading out data and when $\overline{CK3}$ is logic zero, the RAM 220 is writing in data. As previously pointed out, logic one of CK5 is the time slot when valid data is being transmitted through the system. With reference to FIG. 8A, it can be seen that $\overline{CK3}$ pulses do not occur at the same time that CK5 is at logic one. Thus, RAM 220 records or writes in data only at a time after CK5 has sampled previous data and reads out data at the same time CK5 clocks valid data.

The output of exclusive OR gate 222 is connected to one input of NAND gate 224. The other input of NAND gate 224 is connected to the CK5 clock output of clock 10 (FIG. 2). Since Exclusive OR gate 222 will only present a zero output when the data on the data output of RAM 220 is the same as the data of $\overline{SA}$, the output of NAND gate 224 will equal one when $\overline{SA}$ equals data (Dout) of RAM 220 or when CK5 is at logic zero. The data output of NAND gate 224 is identified $\overline{SCH}$ and will only be at logic one when the notes played during the previous scan are the same notes being played during the current scan. If the played notes have changed, $\overline{SCH}$ goes to logic zero during CK5 since the inputs to Exclusive OR gate 222 are not equal. $\overline{SCH}$ is applied to one input of NOR gate 226, and the other input is connected to the Mn output of NOR gate 178. Thus, the output of NOR gate 226 identified SCHM goes to logic one when the $\overline{SCH}$ equals logic zero and Mn equals logic zero. NOR gates 228 and 230 form an RS flip-flop. One input of NOR gate 232 receives time slot 70 data from NAND gate 162 and the other input is connected to the collector of transistor T1. Normally, when no keys are played, the $\overline{1Q}$ output of latch L1 is at logic one ($\overline{GBE1}$ = 1), H is at logic one and transistor T1 is biased "on". When a key is first played from the manual to which the logic is coupled by switch 172, SCHM goes to logic one and H goes to logic zero. When H goes to logic 0, transistor T1 is turned "off" through the coupling action of capacitor 234 and resistor 236. Since GBE1 is high, both resistors 238 and 240 charge capacitor 234 towards +5 volts. As a result, transistor T1 turns "on" in about 15 milliseconds. When it does, NOR gate 232 decodes a logic one when transistor T1 is "on" and when time slot 70 corresponding to a selected manual $\overline{Mn}$ occurs, the output of NOR gate 232 resets RS flip flop 230 and 228 and $\overline{H}$ goes to logic one. If subsequent deletion of keys set H to logic zero, $\overline{H}$ remains logic zero for approximately 40 milliseconds since $\overline{GBE1}$ equals zero and only resistors 240 would charge capacitor 234. The reason for the 40 millisecond delay when keys are released is that it takes longer for the organist to release keys than it does to initially play keys. As long as $\overline{H}$ is logic zero the system is in hold since no data can be clocked through NAND gate 206. Once $\overline{H}$ goes to logic one after a key is played, the data corresponding to the played keys is clocked at each CK5 pulse to the counter latch enable outputs CLE1, CLE2, CLE3, and CLEH in the following manner.

CLE1 is decoded and determined by NAND gate 206, NAND gate 250, and NOR gate 252. It can be seen that if only one key has been played, GBE2 is logic zero so that NAND gate 250 produces a logic one output to one input of NOR gate 252. Thus, the output of NOR gate 252 remains at logic zero as long as only one key is played. However, if two or more keys are played, GBE2 is at logic one. Thus, CLE1 follows the following logic equation:

$$CLE1 = GBE2\ (Q14)\ (\overline{H})\ (Q13)\ (CK5)$$

Accordingly, if two or more keys have played in the previous scan, at the time slot of the first key played when CK5 goes to logic one, CLE1 will go to logic one. Thus, CLE1 goes to logic one for the lowest or first note played when two or more notes are played but remains at logic zero if only one key is played.

CLE2 is decoded by NAND gate 254, NAND gate 256, NAND gate 258, NOR gate 260 and NAND gate 206. CLE2 follows the logic equations:

$$CLE2 = (Q15)\ (Q13)\ (\overline{H})\ (CK5)\ (BE3),$$

$$CLE2 = (\overline{BE3})\ (CLE1).$$

The later equation corresponds to two keys being played since $\overline{BE3}$ equals logic one for less than three keys and CLE1 equals logic one for two or more keys played as defined above.

CLEH is decoded by NOR gate 212 and NAND gate 206. Thus, CLEH follows the equation:

$$CLEH = (HN)(\overline{H})(Q13)(CK5)$$

Thus, it can be seen that CLEH goes to logic one only during the time slot of the highest note played.

CLE3 is decoded by NAND gate 261, 262, 264, NOR gate 266 and NAND gate 206 in accordance with the following logic equations:

$$CLE3 = (Q13)(Q16)(\overline{H})(CK5)(BE3)$$

$$CLE3 = (\overline{BE3})(CLEH)$$

The first equation corresponds to a played key being scanned, the system not in hold, data valid, the third key slot enabled, and three or more keys played on the previous scan. If $\overline{BE3}$ and CLEH equals one, CLE3 equals CLEH equals 1. This corresponds to less than three keys being played on the previous scan therefore, CLE3 and CLEH go to logic one for the time slot of the highest note played when less than three keys have been played. The following table indicates the corresponding note time slots for which the CLE outputs go to logic one when 1, 2, 3 or more keys are played.

| | KEYS PLAYED | |
|---|---|---|
| 1 KEY | 2 KEYS | 3 OR MORE KEYS |
| CLE1 disabled | lowest note | lowest note |
| CLE2 disabled | lowest note | second note |
| CLE3 highest note | highest note | third note |
| CLEH highest note | highest note | highest note |

With reference FIGS. 7A, 7B, 7C, and 7D; CLE1, CLE2, CLE3, and CLEH from FIG. 5 are applied as indicated in FIG. 7A. Also, $\overline{Q7}$, Q8, and Q9 outputs from FF7, FF8, and FF9 in FIG. 4 are connected as indicated. The $\overline{T2}$ through $\overline{T12}$ outputs from counter and decoder 11 in FIG. 3 are connected as indicated in FIG. 7A. CLE1 through CLEH go to logic 1 during the time slot of the played keys in accordance with the previous table. The $\overline{Q7}$, Q8 and Q9 data is the data that decodes into the respective octave slots (01–06). $\overline{T2}$ through $\overline{T12}$ is decoded by eight NAND gates 270 into D1, $\overline{D2}$, $\overline{D3}$, D4, D5, D6, D7, and D8 data in accordance with the truth table chart in FIG. 10A. Four programmable counters 272, 274, 276, and 278 are respectively connected as indicated in FIG. 7B, 7C and 7D. The four programmable counters are identical internally so only programmable counter 272 will be described. Integrated circuit latches 280, 282 and 284 are commercial type 7475 integrated circuits. The gate enable (G) inputs of latches 280–284 are connected to CLE1. The data inputs (1D–4D) of latches 280 and 282 are connected as indicated to D1 through D8. The three data inputs (1D–3D) of latch 284 are connected to $\overline{Q7}$, Q8, and Q9 as indicated. The logic state of D1–D8 at any given moment of time is a function of the inputs $\overline{T2}$–$\overline{T12}$. FIG. 10A indicates the status of the respective D1 - D8 lines for each time slot corresponding to $\overline{T1}$ through $\overline{T12}$. As previously pointed out, CLE1 goes to logic one during the time slot for the first played note when two or more keys are played. When this logic one is applied to the G inputs of latches 280–284, the data on the data inputs at that time is clocked through to the indicated Q outputs of latches 280, 282, and 284. The Q outputs of latches 280 and 282 are connected to the data inputs (1D–4D) of integrated circuit presettable binary counters 286 and 288. These binary counters are commercial type 74197. The output of counter 286 is connected to the clock input of counter 288 and the output (Q4) of counter 288 is connected to flip-flop 290. The Q output of flip-flop 290 is connected to the clock (CK) input of flip-flop 292 and flip-flops 294, 296, 298, and 300 are all connected to divide-by-two operation. Flip-flops 290–300 are all commercial type 74107 JK flip-flops. The Q output of flip-flop 290 is also connected through capacitor 302 to the count/load (C/L) input of counters 286 and 288. The clock (CK) input of counter 286 receives master frequency one (MF1) which is a relatively fixed frequency of approximately 2 mega-Hertz. This MF1 frequency is supplied by rate scaler frequency generator 22 connected to the master frequency generator 23 of the system and can be varied slightly at a subaudio rate to produce vibrato effects as well as varied to slightly detune the output to enhance the ensemble effect.

Counters 286 and 288 and flip-flop 290 are connected to operate as a nine bit counter and operate to count at 512 (2 to the ninth power). Thus, counters 286 and 288 and flip-flop 290 operate to divide MF1 by 512. The D inputs of counters 286 and 288 are the true inputs which program these counters. Thus, depending upon the input logic state of the D inputs, the count of counters 286 and 288 can be varied. Looking at FIG. 10A, it can be seen that the D1 through D8 true code (inverting $\overline{D2}$ and $\overline{D3}$) for time slot $\overline{T1}$ is the binary number for the number 6 0000110). Thus, counters 280 and 282 are programmed to count by the number 512 minus 6 or by 506 (see the N column of FIG. 10A). The number 6 is loaded into the counter at the end of each cycle when the Q output of flip flop 290 transfers a negative pulse to the C/L (Count/Load) input of counters 286 and 288 via capacitor 302. The C/L input is normally biased to a logic one by resistors 303 and 304 and diode 307. The junction of diode 307 and resistor 305 is bypassed by capacitor 309. Similarly, taking any of the other $\overline{T}$ time slots and finding the true binary number representative of the D code for that time slot, it can be seen that the number in the N column of FIG. 10A is the number by which counters 286 and 288 are programmed to divide MF1 if CLE1 goes to logic one during that $\overline{T}$ time slot. MF1 when divided by these numbers N produces the 12 semitones of the top octave of the manual. Flip-flops 292, 294, 296, 298 and 300 divide this frequency down to the each of the lower octaves. As can be seen, each of the Q outputs of flip-flops 290–300 are respectively connected to one of 6 NAND gates 304 in FIG. 7C. The other two inputs of NAND gates 304 are connected to the Q outputs of latch 284. The state of the Q outputs of latch 284 when clocked by CLE1 represents the state of the $\overline{Q7}$, Q9, and Q8 inputs which determines the octave time slot in which the actuated key is located. This data is applied to NAND gates 304 so that only the NAND gate corresponding to the octave of the played key will be enabled to pass that frequency to the output f1.

FIG. 10B indicates the truth table logic of the $\overline{Q7}$, Q9 and Q8 lines for each of the octave time slots 01 through 06. Assuming the first note time slot $\overline{T1}$ for the first octave 01 was the lowest note played, it can be seen that MF1 would be divided by 506 and then divided by flip-flops 290 through 300. The 0, 0, 0, inputs on latch 284 would be clocked through at CLE1 so that the Q outputs would be at zero and the $\overline{Q}$ outputs are at one. It can be seen that only the NAND gate 304 connected to the Q output of flipflop 300 representing the first or lowest octave will be enabled to pass the frequency of the Q output of flip-flop 300. The other NAND gates 304 are turned off. Similarly, all of the other NAND gates 304 are connected only in such a way that they are enabled to pass their respective divided frequency if the state of the Q inputs at the time of CLE1 is such to indicate that a key in that octave has been played.

The digital to analogue converter 271 converts the digital data of programmable counter 272 to analogue voltage V1 as follows. The Q and $\overline{Q}$ outputs of the latch 284 are also respectively connected to NAND gates 306 and 308 and inverters 310, 312 and 314 respectively as indicated in FIG. 7B. The outputs of NAND gates 306 and 308 are connected in series to 17.8K resistor 316 and 53.3K resistor 318. Inverters 310, 312 and 314 are respectively connected to 120K resistor 320, 240K resistor 322 and 480K resistor 324. A 480K resistor 326 is connected from ground to the common bus 328 connected to all of resistors 316–326. Bus 328 is connected to the emitter of transistor 330 in FIG. 7C. The base of transistor 330 is connected through a 1K resistor 332 to a five volt source. The base is also connected through a 2.7K resistor 334 to the 4Q output of latch 282 and through a 5.6K resistor 336 to the 3Q output of latch 282. The 3Q and 4Q outputs of latch 282 represent the D7 and D8 data clocked through latch 284. This data controls the biasing of transistor 330 to transistor on. The base voltage of transistor 330 follows the values under column K in FIG. 10A. The collector of transistor 330 is connected to the input of an operational amplifier 338 and the output of amplifier 338 has been labelled V1. The output of voltage V1 follows the following equation:

$$V1 = 30\,(K/M) + 5$$

where K is the value shown under the column K in FIG. 10A for the played note time slot, and M is the multiplying factor M shown in FIG. 10B for the particular octave of the played note.

The output frequency F1 follows the following equation:

$$F1 = MF1/NM$$

where MF1 is the frequency at the MF1 input, N equals the number under the N column in FIG. 10A for the particular T time slot, and M equals the multiplying factor M in FIG. 10B for the octave of the played note.

Programmable counters 274, 276, and 278 operate in the same manner as previously described with respect to programmable counter 272. Programmable counter 274 receives a master frequency MF2, programmable counter 276 receives a master frequency MF3, and programmable counter 4 receives a master frequency of MFH. The output voltage VH from programmable counter 278 controls the amount of rate scaling by rate scale frequency generator 22 so that input frequencies MF1, MF2, MF3, and MFH may be shifted very slightly to detune these frequencies very slightly to enhance the orchestral effect, as will be described later. The amount of frequency shift at the lower frequency end is by a greater percentage than at the higher frequency end but not enough to give a fixed difference frequency. The four output frequencies f1, f2, f3, and fH and the four voltages V1, V2, V3 and VH are applied to the voltage controlled gate and filter circuits 21. FIGS. 11–13 disclose the orientation of FIGS. 2–7D.

Figure 14:
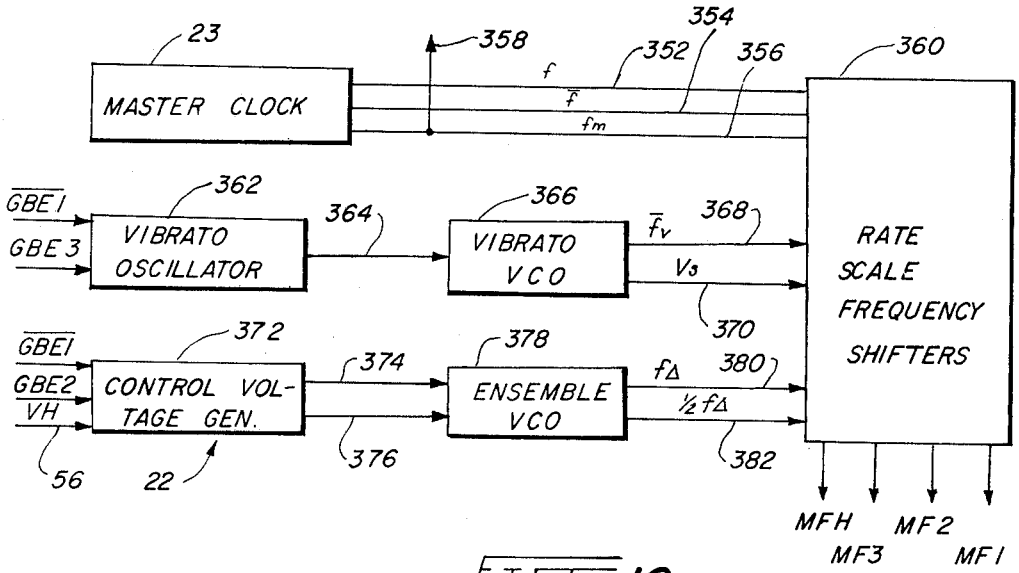
FIG. 14 is a block diagram of the rate scaler frequency generator 22 illustrated in FIG. 1.
Figure 15:
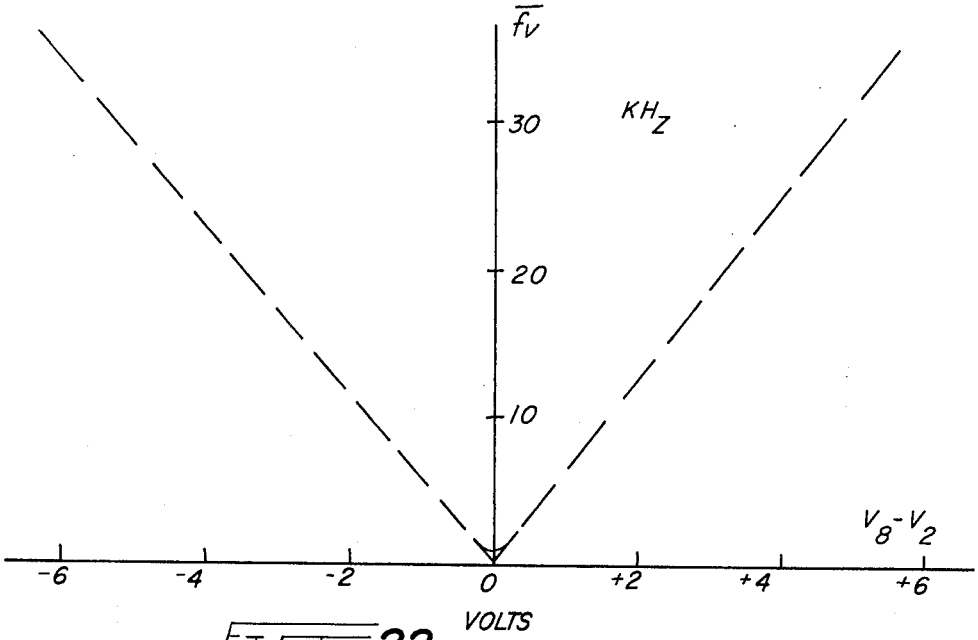
FIG. 15 is a graph showing the voltage versus frequency relationship between the output frequency $\overline{fv}$ and the reference voltages V8-V2 of the vibrato voltage controlled oscillator 366 illustrated in FIG. 14.

With reference to FIG. 14, a more detailed block diagram of the rate scaler frequency generator 22 is illustrated. Master frequency generator 23 provides on three separate leads 352, 354, and 356 frequency signals designated $f$, $\overline{f}$, and fm. The fm output is also connected on lead 358 to the top octave frequency generator dividers 25. Leads 352, 354, and 356 are connected to rate scaled frequency shifters 360, the operation of which will be described below. Rate scaler frequency generator 22 also comprises a vibrato oscillator 362 which is a conventional vibrato oscillator which generates a vibrato signal at approximately 6 Hertz in the manner to be hereinafter described. Vibrator oscillator 362 is connected by a lead 364 to a vibrato voltage controlled oscillator 366. The vibrator voltage controlled oscillator 366 generates an output signal $\overline{fv}$ at a frequency which is approximately proportional to the magnitude of the input vibrato voltage on lead 364 as illustrated in FIG. 15. The $\overline{fv}$ signal is applied on lead 368 to the rate scale frequency shifters 360 and vibrator voltage controlled oscillator 366 also applies a logic voltage signal $V_s$ on lead 370 to rate scale frequency shifters 360.

Rate scaler frequency generator 22 also comprises a control voltage generator 372 which receives the VH signal on lead 56 from the programmable counter circuits 20 and also GBE2 and $\overline{GBE1}$ signals from the mono and enable logic circit 19. VH is a tracking voltage which is proportional to the frequency of the oscillator assigned to the highest note being played as previously described. $\overline{GBE1}$ and GBE2 are signals representative of the number of keys played as previously described. Control voltage generator 372 provides two output signals on leads 374 and 376 to control ensemble voltage control oscillator 378. Ensemble voltage control oscillator 378 provides two output signals f delta and $\frac{1}{2}f$ delta on leads 380 and 382 to rate scale frequency shifters 360 for the purpose that will hereinafter be more fully described. Rate scale frequency shifters 360 receive the respective signals on leads 352, 354, 356, 368, 370, 380 and 382 to provide output frequency signals MF1, MF2, MF3, and MFH which are applied to the programmable counter circuits 20 as previously described.

Figure 16:
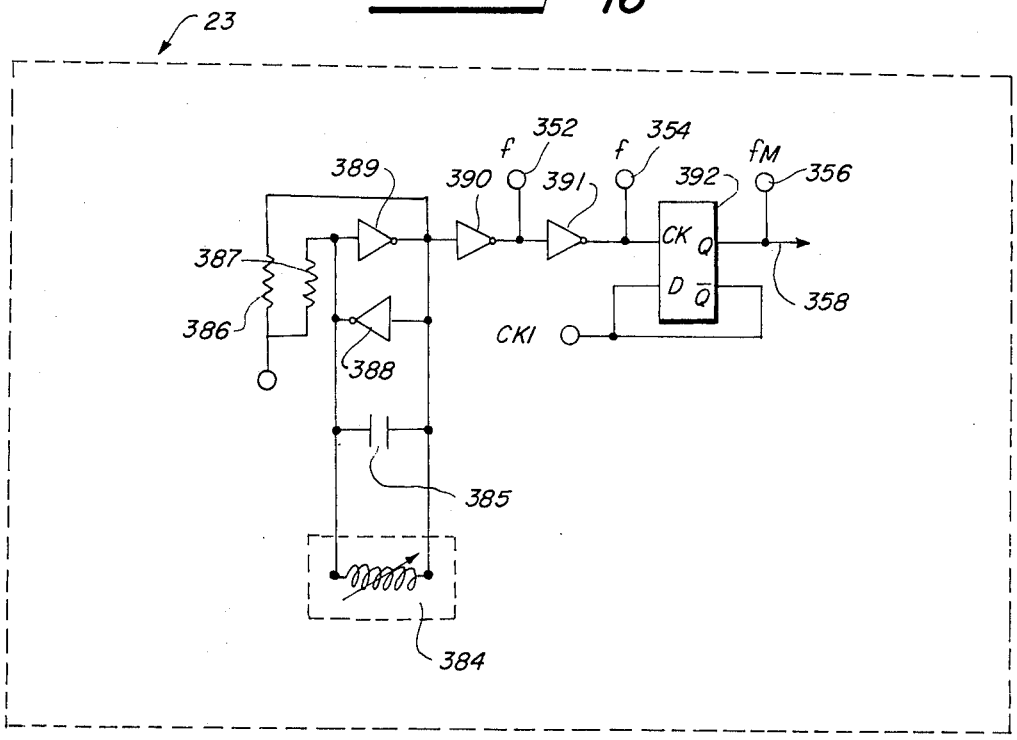
FIG. 16 is a detailed circuit diagram of the master frequency generator 23 illustrated in FIG. 1.
Figure 22:
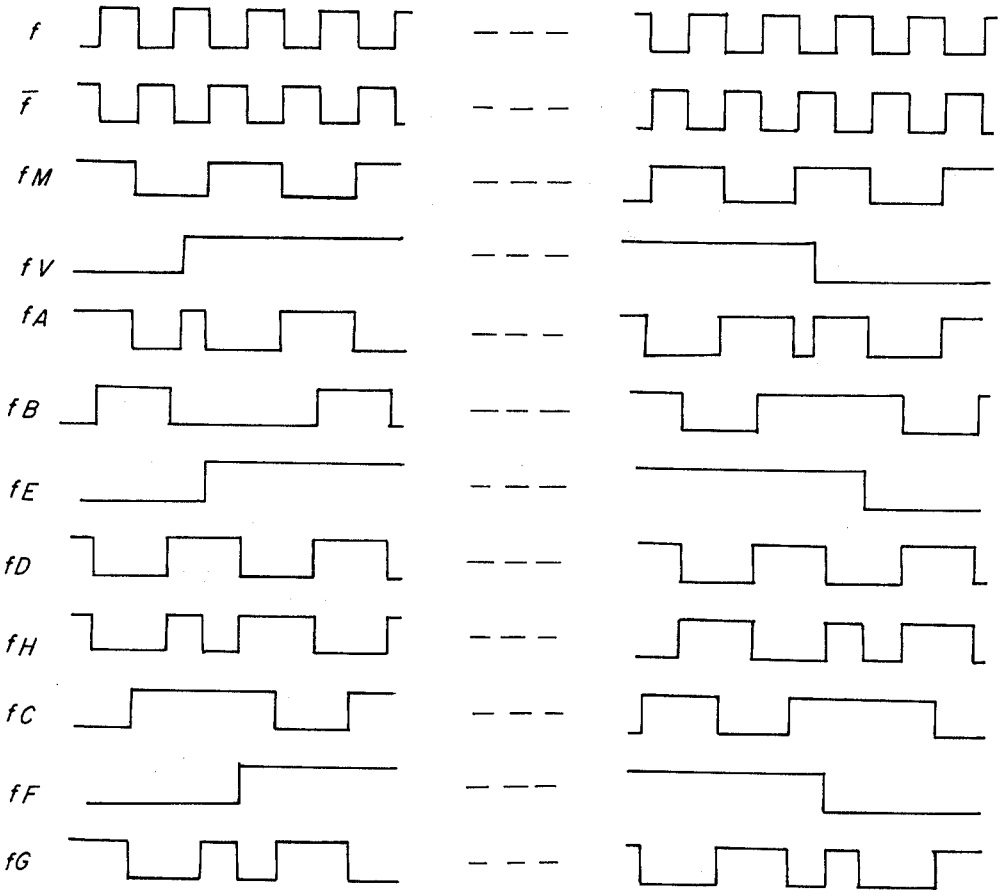
FIG. 22 is a diagram of the wave forms of the rate scaler frequency shifters 360.

With reference to FIG. 16, master frequency generator 23 is a conventional tuneable LC oscillator and divider circuit comprising a tuneable choke coil 384, capacitor 385, resistors 386 and 387, integrated circuit inverter amplifiers 388, 389, 390, 391, and integrated circuit divider 392. The output of inverter amplifier 390 is a square wave signal $f$ on lead 352 as illustrated in FIG. 22. Inverter 391 inverts that signal to produce its complement $\overline{f}$ on lead 354 as illustrated in FIG. 22 and divider 392 divides that signal by two to produce fm on lead 356 illustrated in FIG. 22.

Figure 17:
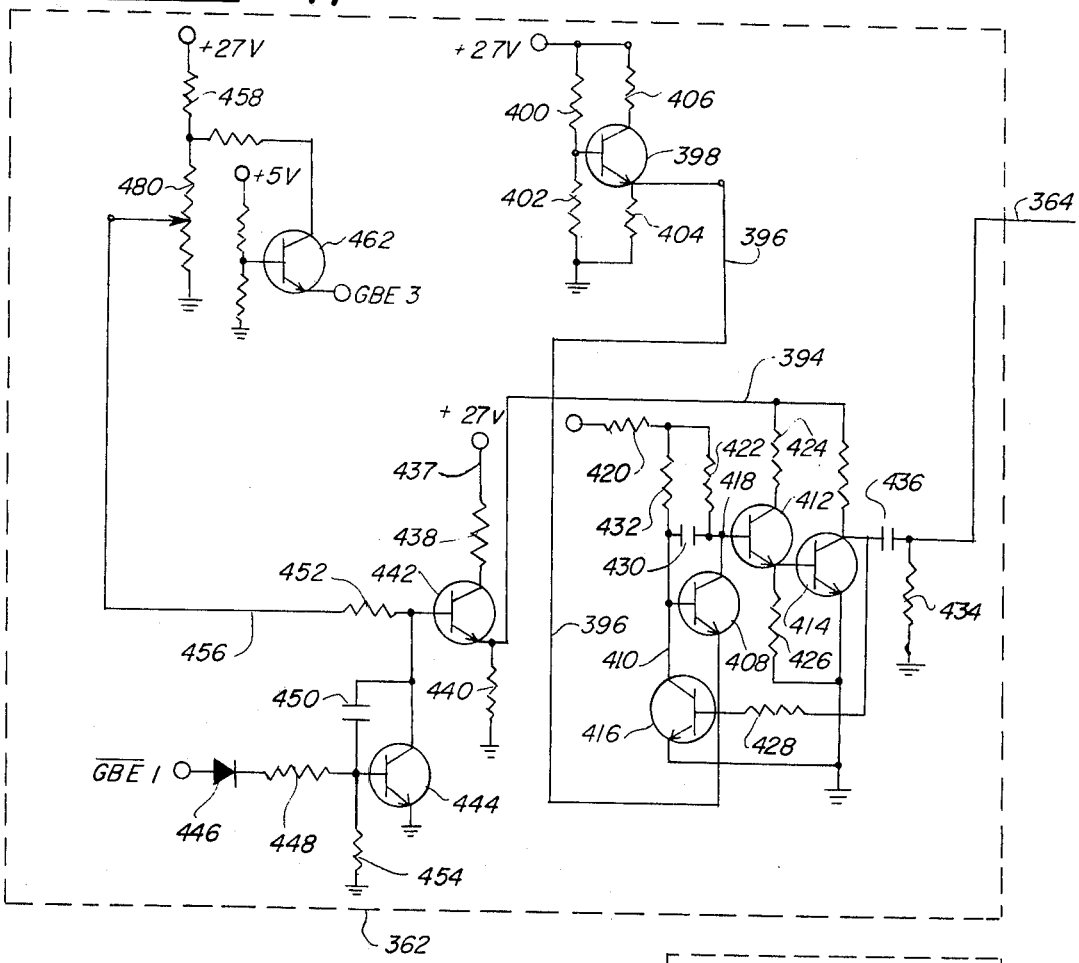
FIG. 17 is a detailed circuit diagram of the vibrato oscillator 362 illustrated in FIG. 14.

With reference to FIG. 17, a detailed schematic circuit diagram of the vibrato oscillator 362 is illustrated. The voltage on lead 394 is the supply voltage which turns the vibrato oscillator "on" and controls the amplitude of the output vibrato signal on lead 364. The voltage on lead 396 is a reference voltage used for the purpose that will be more fully described below. Lead 396 is connected to the emitter of transistor 398 whose base is biased by the voltage developed across voltage divider resistors 400 and 402. Transistor 398 also has an emitter load resistor 404 and a collector supply resistor 406.

Lead 396 is also connected to the emitter of transistor 408 which is a temperature sensitive transistor. The base emitter drop of transistor 408 is compensated by the base emitter drop of transistor 398. This compensation maintains a nearly constant threshold voltage at the base of transistor 408, and accordingly, a stable vibrato output frequency.

Assuming that the voltage on lead 410 to the base of transistor 408 and the voltage on lead 418 at the collector of transistor 408 are at ground potential, transistor 408, transistor 412, and transistor 414 are all biased "off" and transistor 416 is biased "on". The voltage on lead 418 connected to the collector of transistor 408 and the base of transistor 412 will charge positively through resistor 420 and 422, and when the voltage on lead 418 reaches approximately 0.5 volts, transistor 412 is biased "on" passing current from lead 394 through collector supply resistor 424 and emitter load resistor 426 to ground. At approximately one volt, transistor 414 is also biased "on" thereby effectively grounding the base of transistor 416 through resistor 428 turning transistor 416 "off". Capacitor 430 commences charging through resistor 420 and resistor 432 raising the voltage on lead 418 thereby causing transistors 412 and 414 to be biased "on" more substantially. The voltage on lead 418 is clamped by the base to emitter drop of transistors 412 and 414 and the voltage on lead 410 is charged positively. At about one volt, transistor 408 is biased "on" clamping the voltage on lead 410 and driving the voltage on lead 418 negatively. This causes transistors 412 and 414 to turn "off" and transistor 416 turns "on" driving the voltage on leads 410 and 418 back to ground potential.

Accordingly, one cycle of the vibrato oscillator has now been completed and the parameters are back to the initial assumed state of ground potential on leads 410 and 418. The output vibrato signal is coupled through a capacitor 436 and developed across a reference resistor 434 on lead 364.

The reference voltage on lead 394 is developed from the 27 volt voltage source at point 437 through the collector supply resistor 438 and the emitter load resistor 440 connected across transistor 442. When transistor 442 is biased "on", reference voltage across resistor 440 is applied to lead 394 and when transistor 442 is biased "off", lead 394 is essentially grounded through resistor 440.

When the input $\overline{\text{GBE1}}$ is at a logic "one" (no notes played), transistor 444 is biased "on" by diode 446 and resistor 448. The base of transistor 442 is grounded through transistor 454 biasing transistor 442 "off" so that the reference voltage on lead 394 is grounded turning the vibrato oscillator "off". When the first note is played $\overline{\text{GBE1}}$ switches to "zero" logic, and capacitor 450 starts charging through resistor 452 and resistor 454 until the IR drop across resistor 454 is less than one diode drop and transistor 444 is biased. Thus, the voltage at the base of transistor 442 approaches the voltage on lead 456 slowly so that transistor 442 is turned "on" slowly. The final voltage on lead 394, lead 456, and the base of transistor 442 is determined by resistor 458, and the setting of variable resistor 460, when transistor 462 is biased "on", and by the setting of variable resistor 460 when transistor 462 is biased "off". Transistor 462 is biased "off" when GBE3 is at logic "one" and is biased "on" when OBE3 is at logic "zero". When the first note is played, $\overline{\text{GBE1}}$ switches to logic "zero", and the vibrato oscillator turns "on" slowly in a delayed mode. When more than two notes are played, OBE3 switches to logic "one", transistor 462 is biased "off" so that increased voltage is applied on lead 456, and the magnitude of the vibrato oscillator output signal is increased.

Figure 18:
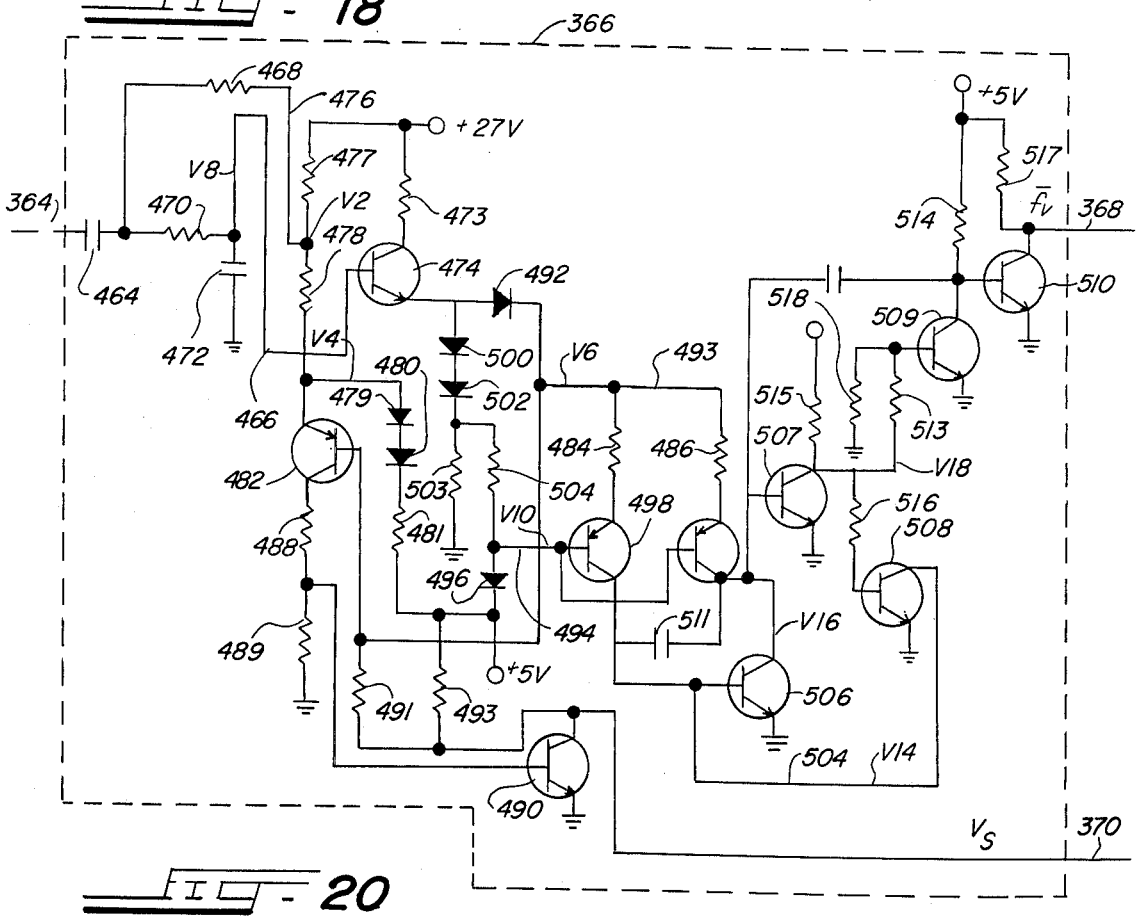
FIG. 18 is a detailed circuit diagram of the vibrato voltage controlled oscillator 366 illustrated in FIG. 14.

With reference to FIG. 18, a detailed circuit diagram of the vibrato voltage control oscillator 366 is illustrated. The output of the vibrato oscillator 362 is applied on lead 364 through capacitor 464 to the junction of resistors 468 and 470. Capacitor 472 is connected from the other side of resistor 470 to ground. Lead 466 is connected from resistor 470 to the base of transistor 474, and lead 476 is connected to the junction of resistors 477 and 478. Resistors 477, 478, diodes 479 and 480, and resistor 481 are connected between +27 volts and +5 volts to establish low impedance reference voltages V2 and V4. Transistor 474 is biased at its base by V2 through resistors 468 and 470. Capacitor 464 is a direct current blocking capacitor and capacitor 472 and resistor 470 filter the vibrato signal to obtain a nearly sinusoidal input to the base of transistor 474. The emitter of transistor 482 is at voltage V4. Resistor 473 is a current limiting supply resistor for transistor 474.

When no vibrato input signal is applied on lead 364, transistor 474 is biased such that very little current flows through resistors 484 and 486 so that voltage V6 is approximately one base to emitter drop of transistor 482 below voltage V4. If transistor 482 is biased "on", resistors 488 and 489 divide the current from transistor 482 so that transistor 490 is biased "on" and transistor 482 is held "on" by the voltage caused by current flowing through resistor 491. If transistor 482 is biased "off", transistor 490 is also biased "off", and diode 492 supplies enough current through resistor 491 and resistor 493 to hold transistor 482 "off". This slight hysteresis effect prevents transistors 482 and 490 from oscillating eradically.

A slight increased in the voltage V8 in lead 466 turns transistors 482 and 490 "off". As voltage V8 increases, voltage V10 on lead 494 is clamped by diode 496 (i.e., one diode drop above five volts), and the current increases through resistor 484 and transistor 498, as well as through resistor 486 and transistor 499. When voltage V8 swings back to normal voltage bias (i.e., V8 equals V2), a slight decrease in voltage turns transistors 482 and 490 "on". As voltage V8 decreases, voltage V6 on lead 493 is clamped by transistor 482, and voltage V4 across the base to emitter junction of transistor 482. Diodes 500 and 502 and resistors 503 and 504 cause voltage V10 to be biased negatively increasing the current through resistor 484 and transistor 498 as well as through resistor 486 and transistor 499.

From the foregoing, it can be seen that the collector current from transistor 498 and transistor 499 increases with the magnitude of the difference between voltage V8 and V2 (i.e., V8 minus V2 greater than zero or V2 minus V8 greater than zero). Voltage Vs on lead 370 is above ground "high" when V8 minus V2 is positive and transistor 490 is biased "off", and is grounded "low" when V8 minus V2 is negative and transistor 490 is biased "on".

For further purposes of explanation, assume initially that voltage V14 on lead 504 equals ground and equals voltage V16 on lead 505. In this situation, transistors 506, 597 and 510 are biased "off" and transistors 508 and 509 are biased "on". The collector current from transistor 499 charges capacitors 511 and 512. Voltage V16 will then increase linearly. When voltage V16 equals one diode drop across transistor 507, it starts to turn "on" and voltage V18 will decrease to three halves of a diode drop across transistor 507. Resistors 518 and 513 will then bias transistor 509 "off". When transistor 509 turns "off", resistor 514 and capacitor 512 supply additional current to speed up the switching action of transistor 507 when the collector current of transistor 499 is barely enough to turn transistor 507 "on". When transistor 507 is turned "on", both voltage V14 and voltage V18 equal zero, and voltage V16 is clamped at one base to emittr diode drop across transistor 507. Transistors 506, 508, and 509 are biased "off" and transistors 507, and 510 are biased "on". Resistor 517 is a collector supply resistor for transistor 510.

The collector current of transistor 498 now charges capacitor 511 and voltage V14 becomes positive. The collector current from transistor 498 through capacitor 511 adds to the current from transistor 499 insuring that transistor 507 remains biased "on". Voltage V14 increases until transistor 506 is biased "on" and voltage V14 is clamped to one base to emitter drop across transistor 506. When transistor 506 turns "on", voltage V16 starts to decrease. Voltage V18 starts to increase until resistors 515 and 516 bias transistor 508 "on". The resulting decrease in voltage V14 is coupled through capacitor 511 to switch transistor 507 "off" and switch transistor 508 "on" very hard. Voltage V14 and voltage V16 now equal zero as originally assumed and the cycle repeats.

The output of transistor 510 is at a frequency $\overline{fv}$ which oscillates at a frequency directly related to the magnitude V8 minus V2 as illustrated in FIG. 15. As pointed out previously, output logic signal voltage $v_s$ is at logic "one" when V8 minus V2 is greater than zero and at logic "zero" when V8 minus V2 is less than zero.

Figure 20:
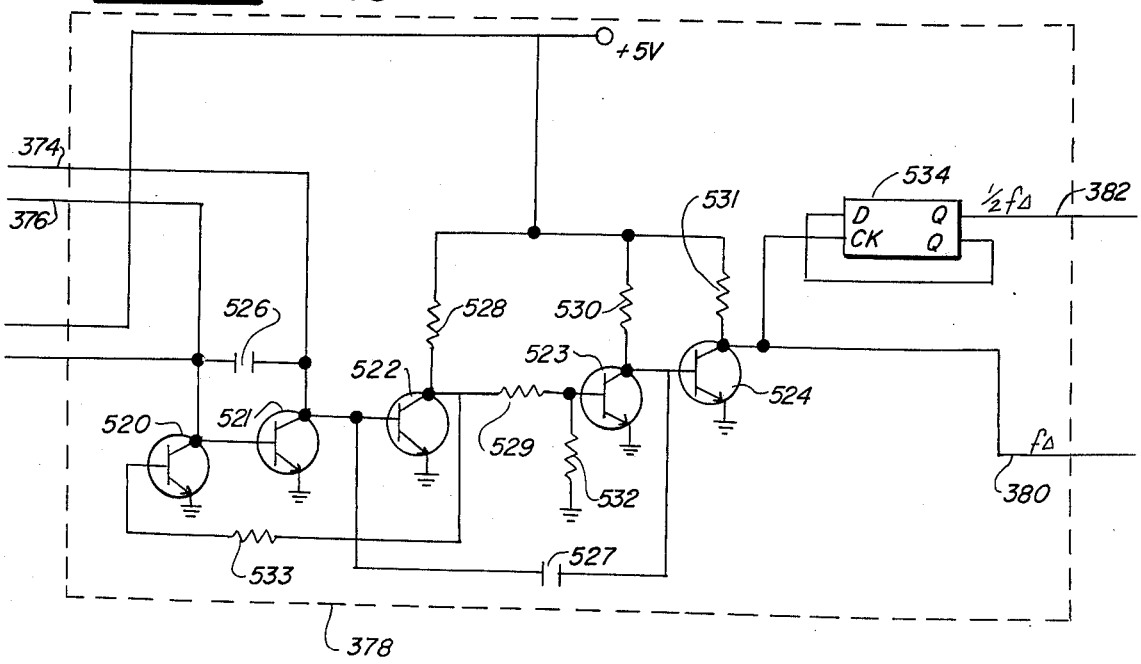
FIG. 20 is a detailed circuit diagram of the ensemble voltage controlled oscillator 378 illustrated in FIG. 14.

With reference to FIG. 20, a detailed circuit diagram of the ensemble voltage control oscillator 37 is illustrated. This circuit is virtually identical to the right hand portion of the circuit illustrated in FIG. 18 and there is a direct component by component correlation. In FIG. 20, transistors 520, 521, 522, 523, and 524 respectively correspond to transistors 508, 506, 507, 509, and 510, in FIG. 18. Capacitors 526 and 527 in FIG. 20 directly correspond to capacitors 511 and 512 in FIG. 18. Similarly, resistors 528, 529, 530, 531, 532 and 533 correspond to resistors 515, 513, 514, 517, 518, and 516 in FIG. 18. This circuit operates in the same manner as the FIG. 18 circuit and the output from transistor 524 is at a frequency f delta on lead 380. An integrated circuit divider 534 divides f delta to produce one-half f delta on lead 382.

Figure 19:
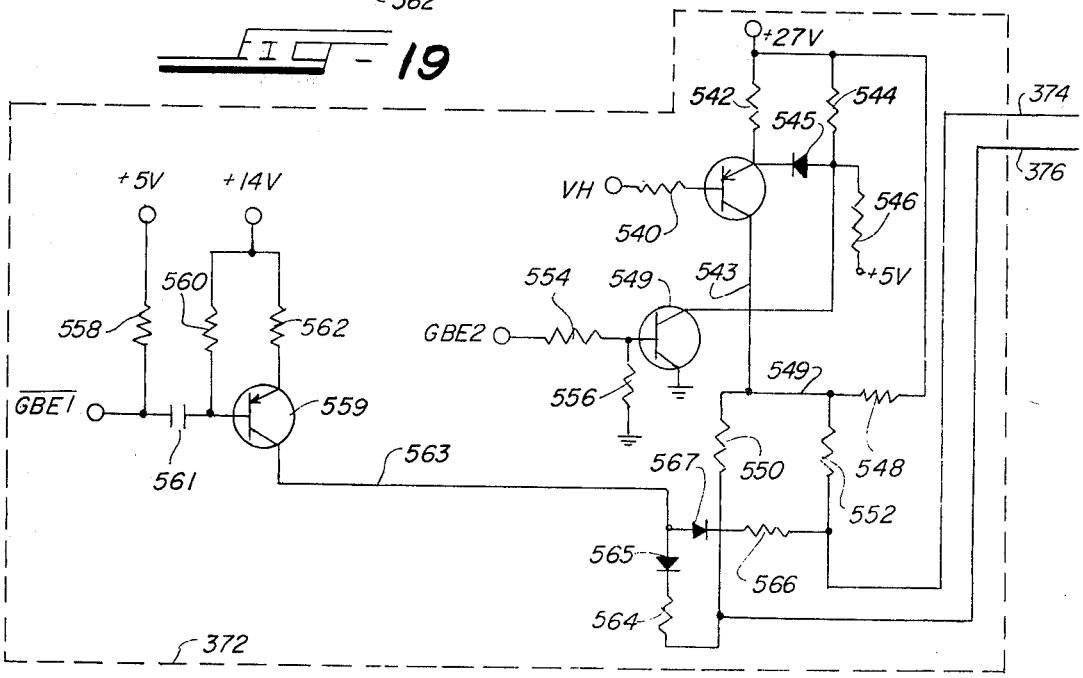
FIG. 19 is a detailed circuit diagram of the control voltage generator 372 illustrated in FIG. 14.

With reference to FIG. 19, a detailed circuit diagram of the control voltage generator 372 is illustrated. Input voltage VH is the tracking voltage the magnitude of which is proportional to the frequency of the oscillator assigned to the highest note being played as previously described. Voltage VH is applied through resistor 540 to the base of transistor 541. Transistor 541 inverts VH and supplies current on lead 543 which current is limited by resistor 542, diode 545, resistor 544, and resistor 546. Resistors 544 and 546 form a voltage divider. When the voltage on the cathode of diode 545 is positive with respect to the voltage on the anode of diode 545, diode 545 is reverse biased and the voltage on the anode is approximately 13 volts. When VH decreases (with decreasing frequency), the voltage on the cathode of diode 545 goes negative and doide 545 is forward biased so that the gain of transistor 541 is increased. Resistor 548 is connected between the "27 volt supply and lead 549. Lead 549 is connected to resistors 550 and 552. Resistors 550 and 552 split the current on lead 549 and apply that current by leads 374 and 376 to each side of capacitor 526 in FIG. 20. The normal current supplied by resistor 548 is sufficient to establish a minimum frequency f delta of approximately 2.5 KHz. When VH swings negatively from approximately 21 volts to 5.5 volts, the frequency *f* delta increases from 2.5 KHz to 8 KHz.

When more than one note is played, GBE2 goes to logic "one" biasing the base of transistor 549 "on" through resistors 554 and 556. This grounds the cathode of diode 545 and the frequency of F delta is reduced to the range 2.5 KHz to 4 KHz.

When the first note is played, $\overline{GBE1}$ goes to logic "zero" thereby grounding the voltage supplied by the 5 volt supply through resistor 558. The base of transistor 559 is switched negative with respect to +14 volts by capacitor 561 and then charged exponentially through resistor 560 to +14 volts as capacitor 561 charges. The exponential base voltage generates an exponential current on lead 563 through transistor 559 and resistor 562. This current is split by diodes 565 and 567 and resistors 564 and 566 and applied by leads 374 and 376 across capacitor 526 in FIG. 20. This causes F delta to be transiently increased to 30 KHz during the onset of the fast attack voices. The transient is negligible by the time the slow attack voices are on.

Figure 21:
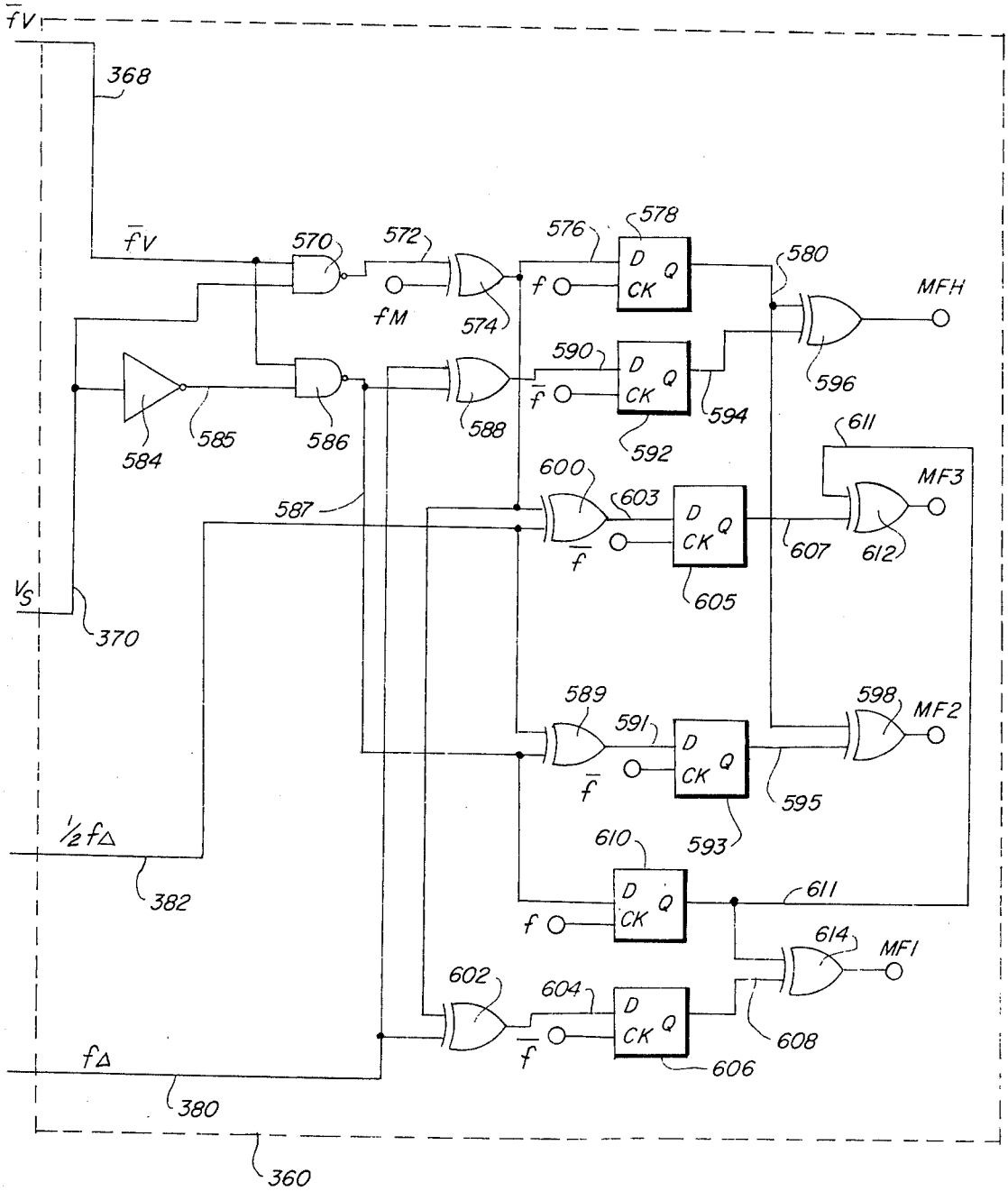
FIG. 21 is a detailed circuit diagram of the rate scaler frequency shifters 360 illustrated in FIG. 14.

With reference to FIG. 21, a detailed schematic diagram of the rate scale frequency shifters 360 is illustrated. The input leads 368 and 370 for $\overline{fv}$ and Vs are from FIG. 18 and input leads 380 and 382 for f delta and one-half f delta are from FIG. 20. Assuming Vs is at a logic "one" (i.e., $V_8 - V_2$ is greater than zero), NAND gate 570 inverts fv to its compliment fv on lead 572. The wave form of fv and the other wave forms relating to FIG. 21 are illustrated in FIG. 22. The input frequency fm to exclusive OR gate 574 is at 2 MHz and the input fv is a maximum of 30 KHz. Therefore, FIG. 22 shows the wave forms just before and after transisitions of fv. Exclusive OR gate 574 operates such that when the input on lead 572 is at "zero", fm occurs on output lead 576, and when lead 572 is at "one" $\overline{fm}$ occurs on lead 576 as shown by the wave forms fv and fA in FIG. 22. The output on lead 576 is sampled by an integrated circuit delay flip-flop 578 at the positive transisitions of the four MHz clock frequency f. The output on lead 580 is shown by wave form fB in FIG. 22. It can be seen that a transition of fv (positive or negative) inverts fA and the succeeding sample of fA by flip-flop 578 does not change fB. Therefore, two transitions or one cycle is deleted from fB for every cycle of fv. Thus, the frequency of fB is the nominal frequency fM minus the vibrato frequency fv.

Now assuming that the voltage on lead 382 equals the voltage on lead 380 and is at zero, and Vs is still logic "one", integrated circuit inverter 584 inverts Vs so that the output lead 585 is at logic "zero", and NAND gate 586 forces a "one" on output lead 587. Exclusive OR gates 588 and 589 produce a "one" on outputs 590 and 591. Delay flip-flops 592 and 593 sample outputs 590 and 591 respectively and yield a "one" on output leads 594 and 595 respectively. Therefore, exclusive OR gates 596 and 598 invert fB on lead 580 and yield fB at the MFH and Mf2 outputs. Frequency $\overline{fB}$ is the same frequency as fB but opposite or complement in phase. Wave form fA on lead 576 is also supplied to exclusive OR gates 600 and 602. Since it has been assumed that the voltage onleads 380 and 382 are zero, the frequency fA appears at the output leads 603 and 604 of exclusive OR gates 600 and 602 respectively. Flip-flops 605 and 606 sample fA at the positive transitions of $\overline{f}$ and yield fC (see FIG. 22) on leads 607 and 608 respectively.

The "one" on lead 587 is sampled by flip-flop 610 at the positive transitions of $f$ which yields a "one" on lead 611. As a result, exclusive OR gates 612 and 614 invert the output on leads 608 and 607 respectively yielding frequency $\overline{fC}$ at the MF3 and MF1 outputs. It can be seen from FIG. 22 that frequency fC is also the nominal frequency fM minus the vibrato frequency fV.

Now assuming that the voltage on leads 380 and 382 are still zero, but that the voltage Vs is now also "zero", NAND gate 570 forces the output on lead 572 to "one" and exclusive OR gate 574 yields fM on lead 576. Since the voltage on leads 380 and 382 equals zero, exclusive OR gates 600 and 602 yield fM on output leads 603 and 604. Flip-flop 578 synchronizes the transitions of fM with the positive transitions of $f$ yielding fD (see FIG. 22) on lead 580. Flip-flops 605 and 606 synchronize the transitions of fM with the positive transitions of $\overline{f}$ yielding $\overline{fD}$ (see FIG. 22) on leads 607 and 608.

Since Vs on lead 370 is at "zero", inverter 584 forces a "one" output on lead 585 and NAND gate 586 yields fv on lead 587. Since the voltage on leads 380 and 382 equal zero exclusive OR gates 588 and 589 yield fv on leads 590 and 591. Flip-flops 592 and 593 synchronize the transitions of fv with the positive transitions of $\overline{f}$ yielding fE on leads 594 and 595. Flip-flop 610 synchronizes the transitions of f with the positive transitions of $f$ yielding fF on lead 611. The combination of frequencies of fF and fM into exclusive OR gates 612 and 614 yields frequency fG (see FIG. 22) at outputs MF3 and MF1. The combination of frequency fD and fE into exclusive OR gates 596 and 598 yields frequency fH at the MFH and MF2 outputs. It can be seen in FIG. 22 that fG and fH have two extra transitions and one extra cycle more than fM for each cycle of fv. Therefore, the output frequency is the nominal frequency fM plus the vibrato frequency fv. Thus, it can be seen that when Vs is at "one" fv is added to fM at each of the MFH, MF1, MF2 and MF3 outputs. In a similar manner the transitions of one-half F delta on lead 382 will be combined by exclusive OR gates 600 with transitions of fv and fM and sampled by flip-flop 605 to add output pulses at the MF3 output. Transitions on lead 382 are combined with the transitions on lead 587 by exclusive OR gate 589, synchronized by flip-flop 593 and subtracted from the frequency on lead 580 by exclusive OR gate 598 to produce an output on MF2.

Similarly, transitions of f delta on lead 380 are subtracted by exclusive OR gate 602, flip-flops 606, exclusive OR gate 614, to produce the MF1 output. Transitions of f delta on lead 380 are added by exclusive OR gate 588, flip-flop 592 exclusive OR gate 596 to produce the MFH output.

It can be see that if a transition occurs on leads 380 or 382 during the same cycle of $\overline{f}$ (from one positive transition to the next) as a transition of fv occurs, both transitions are missed. Since the probability of this occurring is so slight, it cannot be audibly detected.

Thus, it can be seen that the Master frequencies MF1, MF2, MF3, and MFH applied to the programable counters 270, 274, 276 and 278 in FIGS. 7A-C are dynamically controlled and shifted very slightly with respect to one another depending on when the first key is played, the number of keys played, the vibrato voltage controlled oscillator 366, and the ensemble voltage controlled oscillator 378.

It should be apparent that various changes, alterations and modifications may be made to the embodiment illustrated herein without departing from the spirit and scope of the present invention as defined in the appended claims.

I claim:

1. A frequency generator for keyboard electronic musical instruments for generating multiple master tone signals that may be dynamically shifted in frequency with respect to one another comprising:

master frequency clock generator means for producing master clock frequency signals;

vibrato signal means for providing first signals that vary in frequency at a rate depending on the number of keys played;

ensemble signal means for providing second signals the frequency of which varies depending on the time elapsed since a first key was played, the number of keys played, and the highest note of the keys played;

frequency shifting means for receiving the master clock frequency signals, the first signals and the second signals and producing a plurality of output tone signals which are varied in frequency with respect to the master clock frequency signals and to one another in response to variation of the first and second signals.

2. A frequency generator for keyboard electronic musical instruments for generating multiple master tone signals that may be dynamically shifted in frequency with respect to one another comprising:

master frequency clock generator means for producing master clock frequency signals;

first means for producing a sub-audio vibrato signal the magnitude of which is dependent upon the number of keys played;

second means for receiving the vibrato signal and dividing the vibrato signal to a first and a second reference voltage signals dependent upon the instantaneous value of the magnitude of said vibrato signal, providing a first frequency signal dependent upon the magnitude of the difference between said first and second reference voltage signals, and producing a logic signal dependent upon the sign of the difference between said first and the second reference voltage signals;

third means for producing a second and a third frequency signals at frequencies dependent upon the time elapsed since a first key was played, the number of keys played, and the highest note key played.

fourth means for receiving said master clock frequency signals, said first, second, and third frequency signals and said logic signal and producing multiple output master tone signals that are shifted in frequency with respect to the master clock frequency signals and to one another dependent upon the instantaneous logic state of said master clock frequency signals, said first, second, and third frequency signals, and said logic signal.

3. A frequency generator, as claimed in claim 2, wherein said fourth means comprises logic means for sampling said instantaneous logic state of the master clock frequency signals, said first, second, and third frequency signals and said logic signal to shift the multiple output master tone signals with respect to the master clock frequency signals and to one another depending on said instantaneous logic state.

4. A frequency generator, as claimed in claim 2, wherein said first means comprises:

a vibrato oscillator;

means for turning the vibrato oscillator on slowly when one key is played; and means for increasing magnitude of the vibrato signal when more than two keys are played.

5. A frequency generator, as claimed in claim 2 where in said third means comprises:

means for receiving a voltage signal having a magnitude directly proportional to the frequency of the note of the highest key played and changing the frequency of said second and third frequency signals inversely to the magnitude of the voltage signal; and means for sensing the number of keys played and transiently increasing said second and third frequency signals as one note is played but reducing said second and third frequency signals if more than one note is played.

* * * * *

UNITED STATES PATENT AND TRADEMARK OFFICE

CERTIFICATE OF CORRECTION

PATENT NO. : 4,122,744

DATED : October 31, 1978

INVENTOR(S) : Dale M. Uetrecht

It is certified that error appears in the above-identified patent and that said Letters Patent are hereby corrected as shown below:

Col. 6, line 68 - "T" should be -- $\overline{T}$ --;

Col. 8, line 2 - "octave to" should be -- octave of --;

Col. 8, line 16 - "T" should be -- $\overline{T}$ --;

Col. 8, line 62 - "Mn" should be -- $\overline{Mn}$ --;

Col. 9, line 46 - "$\overline{Mn}$" should be -- $\overline{Mn}$ --;

Col. 9, line 49 - "$\overline{Mn}$" should be -- $\overline{Mn}$ --;

Col. 9, line 52 - "$\overline{Mn}$" should be -- $\overline{Mn}$ --;

Col. 9, line 67 - "Q" should be -- $\overline{Q}$ --;

Col. 9, line 68 - "closed" should be -- clocked --;

Col. 10, line 2 - "Q" should be -- $\overline{Q}$ --;

Col. 10, line 4 - "Q" should be -- $\overline{Q}$ --;

Col. 10, line 5 - "Q" should be -- $\overline{Q}$ --;

Col. 10, line 17 - "Q" should be -- $\overline{Q}$ --;

Col. 12, line 10 - "M" should be -- $\overline{M}$ --;

Col. 12, line 13 - "M" should be -- $\overline{M}$ --;

Col. 12, line 18 - "H" should be -- $\overline{H}$ --;

UNITED STATES PATENT AND TRADEMARK OFFICE

CERTIFICATE OF CORRECTION

PATENT NO. : 4,122,744

DATED : October 31, 1978

INVENTOR(S) : Dale M. Uetrecht

It is certified that error appears in the above-identified patent and that said Letters Patent are hereby corrected as shown below:

(PAGE 2)

Col. 12, line 21 - "H" should be -- $\overline{H}$ --;

Col. 12, line 22 - "H" should be -- $\overline{H}$ --;

Col. 12, line 24 - "GBEI" should be -- $\overline{GBEI}$ --;

Col. 12, line 29 - "$\overline{Mn}$" should be -- $\overline{Mn}$ --;

Col. 12, line 31 - "set" should be -- sets --;

Col. 12, line 31 - "H" should be -- $\overline{H}$ --;

Col. 13, line 47 - "octave slots" should be -- octave time slots --;

Col. 14, line 11 - "to divide" should be -- for divide --;

Col. 14, line 25 - "count at" should be -- count to --;

Col. 14, line 34 - "0000110)" should be -- (0000110) --;

Col. 15, line 51 - "T" should be -- $\overline{T}$ --;

Col. 16, lines 3-4 - "FIGS. 11-13 disclose the orientation of FIGS. 2-7D" should be deleted.

Col. 16, line 42 - "purpose" should be -- purposes --;

Col. 18, line 40 - "in lead" should be -- on lead --;

Col. 19, line 13 - "emmitr" should be -- emmiter --;

UNITED STATES PATENT AND TRADEMARK OFFICE

CERTIFICATE OF CORRECTION

PATENT NO. : 4,122,744

DATED : October 31, 1978

INVENTOR(S) : Dale M. Uetrecht

It is certified that error appears in the above-identified patent and that said Letters Patent are hereby corrected as shown below:

(PAGE 3)

Col. 20, line 3 - "27" should be -- +27 --;

Col. 20, line 38 - "inverts fv" should be -- inverts $\overline{fv}$ --;

Col. 20, line 67 - "yield fB" should be -- yield $\overline{f}B$ --;

Col. 20, line 68 - "$\overline{fB}$" should be -- $\overline{f}B$ --;

Col. 21, line 7 - " " should be -- f --;

Col. 21, line 13 - "$\overline{fC}$" should be -- $\overline{f}C$ --;

Col. 21, line 23 - " " should be -- f --;

Col. 21, line 25 - "$\overline{\ }$" should be -- $\overline{f}$ --;

Col. 21, line 32 - "$\overline{\ }$" should be -- $\overline{f}$ --;

Col. 21, line 35 - " " should be -- f --;

Col. 21, line 62 - "$\overline{\ }$" should be -- $\overline{f}$ --;

UNITED STATES PATENT AND TRADEMARK OFFICE

CERTIFICATE OF CORRECTION

PATENT NO. : 4,122,744

DATED : October 31, 1978

INVENTOR(S) : Dale M. Uetrecht

It is certified that error appears in the above-identified patent and that said Letters Patent are hereby corrected as shown below:

Col. 22, line 11 - "I claim:" should be -- Claims --;

Signed and Sealed this

*Seventeenth* Day of *July 1979*

[SEAL]

*Attest:*

*Attesting Officer*

LUTRELLE F. PARKER

*Acting Commissioner of Patents and Trademarks*